US007272973B2

(12) United States Patent
Craig

(10) Patent No.: US 7,272,973 B2
(45) Date of Patent: Sep. 25, 2007

(54) METHODS AND SYSTEMS FOR DETERMINING RESERVOIR PROPERTIES OF SUBTERRANEAN FORMATIONS

(75) Inventor: David P. Craig, Thornton, CO (US)

(73) Assignee: Halliburton Energy Services, Inc., Duncan, OK (US)

( * ) Notice: Subject to any disclaimer, the term of this patent is extended or adjusted under 35 U.S.C. 154(b) by 231 days.

(21) Appl. No.: 11/245,893

(22) Filed: Oct. 7, 2005

(65) Prior Publication Data

US 2007/0079652 A1 Apr. 12, 2007

(51) Int. Cl.
*G01F 15/08* (2006.01)

(52) U.S. Cl. ..... 73/200; 73/861

(58) Field of Classification Search ..... 73/200, 73/861

See application file for complete search history.

(56) References Cited

U.S. PATENT DOCUMENTS

| | | | | |
|---|---|---|---|---|
| 3,285,064 | A | 11/1966 | Greenkorn et al. | 73/155 |
| 4,797,821 | A | 1/1989 | Petak et al. | 364/422 |
| 6,321,840 | B1 * | 11/2001 | Billiter et al. | 166/268 |
| 7,054,751 | B2 * | 5/2006 | Craig | 702/13 |
| 2002/0096324 | A1 | 7/2002 | Poe, Jr. | |
| 2005/0216198 | A1 | 9/2005 | Craig | 702/12 |
| 2005/0222852 | A1 * | 10/2005 | Craig | 705/1 |

OTHER PUBLICATIONS

A Dissertation Entitled "Analytical Modeling of a Fracture-Injection/Falloff Sequence and the Development of a Refracture-Candidate Diagnostic Test" by David Paul Craig, pp. 1-281, May 2006.

Waterflood-Induced Hydraulic Fracturing by Jacob Hagoort, pp. 1-226, Jun. 11, 2004.

Search Report and Written Opinion of International Application No. PCT/GB2006/003658, Feb. 10, 2006.

Esphahanian, C. and Storhaug, D.G.:"A Statistical Approach to Pay Identification in the Tight, Fractured, Heterogeneous Reservoirs of the Piceance Basin," paper SPE 38366 presented at the 1997 Rocky Mountain Regional Meeting, Casper, Wyoming, May 18-21, 1997.

Eberhard, M. and Mullen, M.:"The Effect of Completion Methodologies on Production in the Jonah Field," *SPE Production & Facilities* (Aug. 2003) 145.

(Continued)

*Primary Examiner*—Hezron Williams
*Assistant Examiner*—Rodney Frank
(74) *Attorney, Agent, or Firm*—Robert A. Kent; Baker Botts

(57) ABSTRACT

Methods and systems are provided for evaluating subsurface earth oil and gas formations. More particularly, methods and systems are provided for determining reservoir properties such as reservoir transmissibilities and average reservoir pressures of a formation layer or multiple layers using fracture-injection/falloff test methods. The methods herein may use pressure falloff data generated by the introduction of an injection fluid at a pressure above the formation fracture pressure in conjunction with a fracture-injection/falloff test model to analyze reservoir properties. The fracture-injection/falloff test model recognizes that a new induced fracture creates additional storage volume in the formation and that a fracture-injection/falloff test in a layer may exhibit variable storage during the pressure falloff, and a change in storage may be observed at hydraulic fracture closure.

21 Claims, 7 Drawing Sheets

OTHER PUBLICATIONS

Barree, R.D., et al.:"A Practical Guide to Hydraulic Fracture Diagnostic Technologies," paper SPE 77442 presented at the 2002 SPE Annual Technical Conference and Exhibtion, San Antonio, Texas, Sep. 29-Oct. 2, 2002.

Fisher, K., et al.:"A Comprehensive Study of the Analysis and Economic Benefit of Radioactve Tracer Engineered Stimulation Procedures," paper SPE 30794 presented at the 1995 SPE Annual Technical Conference and Exhibition, Dallas, Texas, Oct. 22-25, 1995.

Griffin, L.G., et al.:"Hydraulic Fracture Mapping of the High-Termpeature, High-Pressure Bossier Sands in East Texas," paper SPE 84489 presented at the 2003 SPE Annual Technical Conference and Exhibition, Denver, Colorado, Oct. 5-8, 2003.

Craig, D.P.:"Analytical Modeling of a Fracture-Injection/Falloff Sequence and the Development of a Refracture-Candidate Diagnostic Test," PhD dissertation, Texas A&M U., College Station, Texas (2005).

Ehlig-Economides, C.A. and Joseph, J.:"A New Test for Determination of Individual Layer Properties in a Multilayered Reservoir," *SPE Formation Evaluation* (Sep. 1987) 261.

Jochen, J.E., et al.:"Quantifying Layered Reservoir Properties With a Novel Permeability Test," paper SPE 25864 presented at the 1993 SPE Rocky Mountain Regional/Low Permeability Symposium, Denver, Colorado, Apr. 12-14, 1993.

Hopkins, C.W., et al.:"The Use of Injection/Falloff Tests and Pressure Buildup Tests to Evaluate Fracture Geometry and Post-Stimulation Well Performance in the Devonian Shales," paper SPE 23433 presented at the 1991 SPE Eastern Regional Meeting, Lexington, Kentucky, Oct. 22-25, 1991.

Reeves, S.R.:"Natural Gas Production Enhancement via Restimulation," final report, Contract No. 5097-210-4090, Gas Research Institute, Chicago, Illinois (Jun. 2001).

Huang, H., et al.:"A Short Shut-In Time Testing Method for Determining Stimulation Effectiveness in Low Permeability Gas Reservoirs," *GASTips* (Fall 2000), 6, No. 4, 28.

Frantz, J.H., Jr., et al.:"Novel Well Testing Procedures Prove Successful in Dakota Formation Infill Program, San Juan Basin," paper SPE 71519 presented at the 2001 SPE Annual Technical Conference and Exhibition, New Orleans, Louisiana, Sep. 30-Oct. 3, 2001.

Craig, D.P., et al.:"Permeability, Pore Pressure, and Leakoff-Type Distributions in Rocky Mountain Basins," *SPE Production & Facilities* (Feb. 2005) 48.

Mayerhofer, M.J. and Economides, M.J.: "Permeability Estimation From Fracture Calibration Treatments," paper SPE 26039 presented at the 1993 Western Regional Meeting, Anchorage, Alaska, May 26-28, 1993.

Mayerhofer, M.J., Ehlig-Economides, C.A., and Economides, M.J.: "Pressure-Transient Analysis of Fracture-Calibration Tests," JPT (Mar. 1995) 229.

Gu, H., et al.:"Formation Permeability Determination Using Impulse-Fracture Injection," paper SPE 25425 presented at the 1993 SPE Production Operations Symposium, Oklahoma City, Oklahoma, Mar. 21-23, 1993.

Abousleiman, Y., Cheng, A. H-D., and Gu, H.: Formation Permeability Determination by Micro or Mini-Hydraulic Fracturing, *J. of Energy Resources Technology* (Jun. 1994) 116, No. 6, 104.

Larsen, L. and Bratvold, R.B.: "Effects of Propagating Fractures on Pressure-Transient Injection and Falloff Data," paper SPE 20580 presented at the 1990 SPE Annual Technical Conference and Exhibition, New Orleans, Louisiana, Sep. 23-26, 1990.

Peres, A.M.M., et al.:"A New Genral Pressure-Analysis Procedure for Slug Tests," *SPE Formation Evaluation* (Dec. 1993) 292.

Koning, E.J.L. and Niko, H.: "Fractured Water-Injection Wells: A Pressure Falloff Test for Determining Fracturing Dimensions," paper SPE 14458 presented at the 1985 Annual Technical Conference and Exhibition of the Society of Petroleum Engineers, Las Vegas, NV, Sep. 22-25, 1985.

Koning, E.J.L.:"Waterflooding Under Fracturing Conditions," PhD Thesis, Delft Technical University, 1988.

van den Hoek, P.J.: "Pressure Transient Analysis in Fractured Produced Water Injection Wells," paper SPE 77946 presented at the 2002 SPE Asia Pacific Oil & Gas Conference, Melbourne, Australia, Oct. 8-10, 2002.

van den Hoek, P.J.: "A Novel Methodology to Derive the Dimensions and Degree of Containment of Waterflood-Induced Fractures From Pressure Transient Analysis," paper SPE 84289 presented at the 2003 SPE Annual Technical Conference and Exhibition, Denver, Colorado, Oct. 5-8, 2003.

Spivey, J.P. and Lee, W.J.: "Variable Wellbore Storage Models for a Dual-Volume Wellbore," paper SPE 56615 presented at the 1999 SPE Annual Technical Conference and Exhibition, Houston, Texas, Oct. 3-6, 1999.

Cinco-Ley, H. and Samaniego-V., F.:"Transient Pressure Analysis: Finite Conductivity Fracture Case Versus Damage Fracture Case," paper SPE 10179 presented at the 1981 SPE Annual Technical Conference and Exhibition, San Antonio, Texas, Oct. 5-7, 1981.

Valkó, P.P. and Economides, M.J.: "Fluid-Leakoff Delineation in High Permeability Fracturing," *SPE Production & Facilities* (May 1999) 117.

Correa, A.C. and Ramey, H.J., Jr.: "Combined Effects of Shut-In and Production: Solution With a New Inner Boundary Condition," paper SPE 15579 presented at the 1986 SPE Annual Technical Conference and Exhibition, New Orleans, Lousiana, Oct. 5-8, 1986.

Correa, A.C. and Ramey, H.J., Jr.: "A Method for Pressure Buildup Analysis of Drillstem Tests," paper SPE 16802 presented at the 1987 SPE Annual Technical Conference and Exhibition, Dallas, Texas, Sep. 27-30, 1987.

Correa, A.c. and Ramey, H.J., Jr.: "Application of the Unit Step Function to Unusual Well Test Problems," paper SPE 18156 presented at the 1988 SPE Annual Technical Conference and Exhibition, Houston, Texas, Oct. 2-5, 1988.

Ozkan, E. and Raghavan, R.: "New Solutions for Well-Test-Analysis Problems: Part 1—Analytical Considerations," *SPEFE* (Sep. 1991), 359.

Ozkan, E. and Raghavan, R.: "New Solutions for Well-Test-Analysis Problems: Part 2—Computational Considerations and Applications," *SPEFE* (Sep. 1991), 369.

Nolte, K.G.:"Determination of Fracture Parameters From Fracturing Pressure Decline," paper SPE 8341 presented at the 1979 SPE Annual Technical Conference and Exhibition, Dallas, Texas, Sep. 23-25, 1979.

Hagoort, J.:"Waterflood-induced hydraulic fracturing," PhD Thesis, Delft Technical University, 1981.

Ozkan, E., Yildiz, T., and Kuchuk, F.J.:"Transient Pressure Behavior of Duallateral Wells," SPE 38760 presented at the 1997 SPE Annual Technical Conference and Exhibition, San Antonio, Texas Oct. 5-8, 1997.

Raghavan, R., Chen, C-C, and Agarwal, B.: "An Analysis of Horizontal Wells Intercepted by Multiple Fractures," SPEJ (Sep. 1997) 235.

Kuchuk, F.J., et al.:"Pressure-Transient Behavior of Horizontal Wells With and Without Gas Cap or Aquifer," *SPE Formation Evaluation* (Mar. 1991) 86.

Wilkinson, D. and Hammond, P.S.:"A Perturbation Method for Mixed Boundary-Value Problems in Pressure Transient Testing," *Transport in Porous Media* (1990) 5, 609-636.

Stehfest, H.:"Numerical Inversion of Laplace Transforms," Communications of the ACM (Jan. 1970), 13, No. 1, 47-49.

Cinco-L., H., Samaniego-V, F., and Dominguez-A, F.:"Transient Pressure Behavior for a Well With a Finite-Conductivity Vertical Fracture," *SPEJ* (Aug. 1978) 253.

Cinco-Ley, H. and Samaniego-V., F.:"Transient Pressure Analysis: Finite Conductivity Fracture Case Versus Damage Fracture Case," paper SPE 10179 presented at the 1981 SPE Annual Technical Conference and Exhibiton, San Antonio, Texas, Oct. 5-7, 1981.

Craig, D.P.: "Methods and an Apparatus for Detecting a Fracture With Significant Residual Width From Previous Treatments," Patent application, filed Mar. 31, 2004.

Valkó, P.P. and Economidies, M.J.: "Fluid-Leakoff Delineation in High Permeability Fracturing," *SPE Production & Facilities* (May 1999) 117.

Ayoub, J.A., et al.: "Impulse Testing," SPE Formation Evaluation (Sep. 1988) 534.
Ramey, H.J., Jr., Agarwal, R.G., and Martin, I.: "Analysis of 'Slug Test' or DST Flow Period Data," J. Cdn. Pet. Tech. (Jul.-Sep. 1975) 37.
Mayerhofer, M.J. and Economides, M.J.: "Permeability Estimation From Fracture Calibration Treatments," paper SPE 26039 presented at the 1993 Western Regional Meeting, Anchorage, Alaska, May 26-28, 1993.
Ramey, H.J., Jr. and Agarwal, R.G.: "Annulus Unloading Rates as Influenced by Wellbore Storage and Skin Effect," SPEJ (Oct. 1972) 453; Trans. AIME, 253.
Rushing, J.A., et al.: "Analysis of Slug Test Data From Hydraulically Fractured Coalbed Methan Wells," paper SPE 21492 presented at the 1991 SPE Gas Technology Symposium, Houston, Texas Jan. 23-25, 1991.
Ramey, H.J. Jr. and Gringarten, A.C.: "Effect of High Volume Vertical Fractures on Goethermal Steam Well Behavior," Proc., Second United Nations Symposium on the Use and Development of Geothermal Energy, San Francisco, California May 20-29, 1975.
Xiao, J.J. and Reynolds, A.C.: "A Pseudopressure-Pseudotime Transformation for the Analysis of Gas Well Closed Chamber Tests," paper SPE 25879 presented at the 1993 SPE Rocky Mountain Regional/Low-Permeability Reservoirs Symposium, Denver, Colorado, Apr. 12-14, 1993.
Lee, W.J. and Holditch, S.A.: "Application of Pseudotime to Buildup Test Analysis of Low-Permeability Gas Wells With Long-Duration Wellbore Storage Distortion," JPT (Dec. 1982) 2877.
Meunier, D.F., et al.: "Gas Well Test Analysis: Use of Normalized Pseudovariables," SPEFE (Dec. 1987) 529.
Barree, R.D. and Mukherjee, H.: "Determination of Pressure Dependent Leakoff and its Effect on Fracture Geometry," paper SPE 36424 presented at the 1996 SPE Annual Technical Conference and Exhibiton, Denver, Colorado, Oct. 6-9, 1996.
Howard, G.C. and Fast, C.R.: Optimum Fluid Characteristics for Fracture Extension, Drilling and Production Practices (1957), API; 261-270.
Valkó, P. and Economides, M.J.: "Material Balance," Hydraulic Fracture Mechanics, John Wiley & Sons, New York City (1997) Chap. 8, 165-188.
Valkó, P. and Economides, M.J.: "Fracture Height Containment With Continuum Damage Mechanics," paper SPE 26598 presented at the 1993 SPE Annual Technical Conference and Exhibition, Houston, Texas Oct. 3-6, 1993.
Oberhettinger, F.: "Hypergeometric Functions," Handbook of Mathematical Functions, Milton Abramowitz and Irene A. Stegun (eds.), Dover Publications, New York City (1965). Chap. 15, 555-566.
Nolte, K.G.: "A General Analysis of Fracturing Pressure Decline With Application to Three Models," SPEFE (Dec. 1986) 57.
Craig, D.P., Eberhard, M.J., and Barree, R.D.: "Adapting High Permeability Leakoff Analysis to Low Permeability Sands for Estimating Reservoir Engineering Parameters," paper SPE 60291 presented at the 2000 SPE Rocky Mountain Regional/Los Permeabiltiy Reservoirs Symposium, Denver, Colorado, Mar. 12-15, 2000.
Gringarten, A.C., Ramey, H.J., Jr., Raghavan, R.: "Unsteady-State Pressure Distributions Created by a Well With a Single Infinite-Conductivity Vertical Fracture," SPEJ (Aug. 1974) 347.
Craig, D.P.: "Methods and Apparatus for Estimating Physical Parameters of Reservoirs Using Pressure Transient Fracture Injection/Falloff Test Analysis," Patent application, filed Mar. 31, 2004.
Ehlig-Economides, C.A., Fan, Y., and Economides, M.J.: "Interpretation Model for Fracture Calibration Tests in Naturally Fractured Reservoirs," paper SPE 28690 presented at the 1994 SPE International Petroleum Conference and Exhibition of Mexico, Veracruz, Mexico, Oct. 10-13, 1994.
Nolte, K.G.: "Background for After-Closure Analysis of Fracture Calibration Tests," unsolicited paper SPE 39407 available from SPE, Richardson, Texas (1997).
Bourdet, D.: "Special Tests,," *Well Test Analysis: The Use of Advanced Interpretation Models*, Elsevier, New York (2002), Chap. 9, 335.
Butler, J.J., Jr.: "The Performance of Slug Tests," *The Design, Performance, and Analysis of Slug Tests*, Lewis Publishers, Boca Raton (1997), 33.
Kuuskraa, V.A., et al.: "Economic and Technical Rationale for Remediating Inefficiently Producing Eastern Gas Shale and Coalbed Methane Wells," paper SPE 26894 presented at the 1993 SPE Eastern Regional Conference & Exhibition, Pittsburgh, Pennsylvania, Nov. 2-4, 1993.
Hower, T.L. and Decker, M.K.: "Identifying Recompletion Candidates in Stratified Gas Reservoirs," paper SPE 24307 presented at the 1992 SPE Mid-Continent Gas Symposium, Amarillo, Texas, Apr. 13-14, 1992.
Fetkovich, M.J., et al.: "Depletion Performance of Layered Reservoirs Without Crossflow," *SPE Formation Evaluation* (Sep. 1990) 310.
Fetkovich, M.J.: "Advanced Decline Curve Analysis Identifies Fracture Stimulation Potential," paper 38903 presented at the 1997 SPE Annual Technical Conference and Exhibition, San Antonio, Texas, Oct. 5-8.
McCoy, T.F., et al.: "Depletion Performance of Poorly Stimulated Layered Reservoirs Without Crossflow," paper SPE 59757 presented at the 2000 SPE/CERI Gas Technology Symposium, Calgary, Alberta, Canada, Apr. 3-5, 2000.
McCain, W.D., et al.: "A Tight Gas Field Study: Carthage (Cotton Valley) Field," paper SPE 26141 presented at the 1993 SPE Gas Technology Symposium, Calgary, Alberta, Canada, Jun. 28-30, 1993.
Voneiff, G.W. and Cipolla, C.: "A New Approach to Large-Scale Infill Evaluations Applied to the OZONA (Canyon) Gas Sands," paper SPE 35203 presented at the 1996 SPE Permian Basin Oil & Gas Recovery Conference, Midland, Texas, Mar. 27-29, 1996.
Mohaghegh, S.: "Performance Drivers in Restimulation of Gas-Storage Wells," *SPE Reservoir Evaluation & Engineering* (Dec. 2001) 536.
Shelley, F.R.: "Artificial Neural Networks Identify Restimulation Candidates in the Red Oak Field," paper SPE 52190 presented at the 1999 SPE Mid-Continent Operations Symposium, Oklahoma City, Oklahoma, Mar. 28-31, 1999.
Oberwinkler, C. and Economides, M.J.: "The Definitive Identification of Candidate Wells for Refracturing," paper SPE 84211 presented at the 2003 SPE Annual Technical Conference and Exhibition, Denver, Colorado, Oct. 5-8, 2003.
Conway, M.W., et al.: "Expanding Recoverable Reserves Through Refracturing," paper SPE 14376 presented at the 1985 SPE Annual Technical Conference and Exhibition of the Society of Petroleum Engineers, Las Vegas, Nevada, Sep. 22-25, 1985.
Voneiff, G.W., et al.: "The Effects of Unbroken Fracture Fluid on Gas Well Performance," SPE 26664 available from SPE, Richardson, Texas (1994).
Williams, P.: "Value in the Vicksburg," *Oil & Gas Investori* (Aug. 2004) 24, No. 8, 49.
Williams, P.: "The Barnett Shale," *Oil & Gas Investor* (Mar. 2002) 22, No. 3, 34.
Williams, P.: "Wattenberg Revival," *Oil & Gas Investor* (Mar. 1999) 19, No. 3, 22.
Moritis, G.: "Diagnosing Underperforming Wells," *Oil & Gas Journal* (Dec. 4, 2000) 98, No. 49, 23.
Elbel, J.L. and Mack, M.G.: "Refracturing: Observations and Theories," paper SPE 25464 presented at the 1993 SPE Producdtion Operations Symposium, Oklahoma City, Oklahoma, Mar. 21-23, 1993.
Wright, C.A., et al.: "Reorientation of Proposed Refracture Treatments in the Lost Hills Field," paper SPE 27896 presented at the 1994 SPE Western Regional Meeting, Long Beach, California, Mar. 23-25, 1994.
Wright, C.A., et al., "Reorientation of Propped Refracture Treatments," paper SPE 28078 presented at the 1994 SPE/ISRM Rock Mechanics in Petroleum Engineering Conference, Delft, The Netherlands, Aug. 29-31, 1994.
Wright, C.A. and Conant, R.A.: "Hydraulic Fracture Reorientation in Primary and Secondary Recovery from Low-Permeability Reservoirs," paper SPE 30484 presented at the 1995 SPE Annual Technical Conference and Exhibition, Dallas, Texas, Oct. 22-25, 1995.

Siebrits, E., et al.: "Refracture Reorientation Enhances Gas Production in Barnett Shale Tight Gas Wells," Spe 63030 presented at the 2000 SPE Annual Technical Conference and Exhibition, Dallas, Texas, Oct. 1-4, 2000.

Howard, G.C. and Fast, C.R.: "Results of Hydraulic Fracturing," *Hydraulic Fracturing*, Monograph Series, SPE, Richardson, Texas (1970) 2, 172-176.

Reese, J.L., et al.: "Selecting Economic Refracturing Candidates," paper SPE 28490 presented at the 1994 SPE Annual Technical Conference and Exhibition, New Orleans, Louisiana, Sep. 25-28, 1994.

Crowell, R.F. and Jennings, A.R.: "A Diagnostic Technique for Restimulation Candidate Selection," paper SPE 7556 prsented at the 1978 SPE Annual Fall Technical Conference and Exhibition, Houston, Texas, Oct. 1-3, 1978.

Kauuskraa, V.A., et al.: "Economic and Technical Rationale for Remediating Inefficiently Producing Eastern Gas Shale and Coalbed Methane Wells," paper SPE 26894 presented at the 1993 SPE Eastern Regional Conference & Exhibition, Pittsburgh, Pennsylvania Nov. 2-4, 1993.

Hower, T.L. and Decker, M.K.:"Identifying Recompletion Candidates in Stratified Gas Reservoirs," paper SPE 24307 presented at the 1992 SPE Mid-Continent Gas Symposium, Amarillo, Texas, Apr. 13-14.

Fetkovich, M.J., et al.:"Depletion Performance of Layered Reservoirs Without Crossflow," *SPE Formation Evaluation* (Sep. 1990) 310.

Fetkovich, M.J.:"Advanced Decline Curve Analysis Identifies Fracture Stimulation Potential," paper SPE 38903 presented at the 1997 SPE Annual Technical Conference and Exhibition, San Antonio, Texas, Oct. 5-8, 1997.

McCoy, T.F., et al.:"Depletion Performance of Poorly Stimulated Layered Reservoirs Without Crossflow," paper SPE 59757 presented at the 2000 SPE/CERI Gas Technology Symposium, Calgary, Alberta, Canada, Apr. 3-5, 2000.

Reeves, S.R., et al.:"Restimulation of Tight Gas Sand Wells in the Rocky Mountain Region," paper SPE 55627 presented at the 1999 SPE Rocky Mountain Regional Meeting, Gillette, Wyoming, May 15-18, 1999.

Reeves, S.R., et al.:"Restimulation Technology for Tight Gas Sand Wells," paper SPE 56482 presented at the 1999 SPE Annual Technical Conference and Exhibition, Houston, Texas, Oct. 3-6, 1999.

Reeves, S. and Wolhart, S.:"Study Looks at Tight-Gas Restimulation Candidate Wells," *Oil & Gas Journal* (Oct. 8, 2001) 99, No. 41, 37.

Cox, D.O., et al.:"Advanced Typed Curve Analysis for Low Permeability Gas Reservoirs," paper SPE 35595 prsented at the 1996 SPE Gas Technology Conference, Calgary, Alberta, Canada, Apr. 28-May 1, 1996.

Reeves, S. and Wolhart, S.:"Insights Into Restimulation Candidate Selection," *GasTIPS* (Fall 2001) 7, No. 4, 15.

Ely, J.W., et al.:"Restimulation Program Finds Success in Enhancing Recoverable Reserves," paper SPE 63241 presented at the 2000 SPE Annual Technical Conference and Exhibition, Dallas, Texas, Oct. 1-4, 2000.

Hopkins, C.W., et al.:"Screening Restimulation Candidates in the Antrim Shale," paper SPE 29172 presented at the 1994 SPE Eastern Regional Conference & Exhibition, Charleston, West Virginia, Nov. 8-10, 1994.

* cited by examiner

METHODS AND SYSTEMS FOR DETERMINING RESERVOIR PROPERTIES OF SUBTERRANEAN FORMATIONS

CROSS-REFERENCE TO RELATED APPLICATION

The present invention is related to co-pending U.S. application Ser. No. 11/245,839 entitled "Methods and Systems for Determining Reservoir Properties of Subterranean Formations with Pre-existing Fractures," filed concurrently herewith, the entire disclosure of which is incorporated herein by reference.

BACKGROUND

The present invention relates to the field of oil and gas subsurface earth formation evaluation techniques and more particularly, to methods and systems for determining reservoir properties of subterranean formations using fracture-injection/falloff test methods.

Oil and gas hydrocarbons may occupy pore spaces in subterranean formations such as, for example, in sandstone earth formations. The pore spaces are often interconnected and have a certain permeability, which is a measure of the ability of the rock to transmit fluid flow. Evaluating the reservoir properties of a subterranean formation is desirable to determine whether a stimulation treatment is warranted and/or what type of stimulation treatment is warranted. For example, estimating the transmissibility of a layer or multiple layers in a subterranean formation can provide valuable information as to whether a subterranean layer or layers are desirable candidates for a fracturing treatment. Additionally, it may be desirable to establish a baseline of reservoir properties of the subterranean formation to which comparisons may be later made. In this way, later measurements during the life of the wellbore of reservoir properties such as transmissibility or stimulation effectiveness may be compared to initial baseline measurements.

Choosing a good candidate for stimulation may result in success, while choosing a poor candidate may result in economic failure. To select the best candidate for stimulation or restimulation, there are many parameters to be considered. Some important parameters for hydraulic fracturing include formation permeability, in-situ stress distribution, reservoir fluid viscosity, skin factor, transmissibility, and reservoir pressure.

Many conventional methods exist to evaluate reservoir properties of a subterranean formation, but as will be shown, these conventional methods have a variety of shortcomings, including a lack of desired accuracy and/or an inefficiency of the method resulting in methods that may be too time consuming.

Conventional pressure-transient testing, which includes drawdown, buildup, or injection/falloff tests, are common methods of evaluating reservoir properties prior to a stimulation treatment. However, the methods require long test times for accuracy. For example, reservoir properties interpreted from a conventional pressure buildup test typically require a lengthy drawdown period followed by a buildup period of a equal or longer duration with the total test time for a single layer extending for several days. Additionally, a conventional pressure-transient test in a low-permeability formation may require a small fracture or breakdown treatment prior to the test to insure good communication between the wellbore and formation. Consequently, in a wellbore containing multiple productive layers, weeks to months of isolated-layer testing can be required to evaluate all layers. For many wells, especially for wells with low permeability formations, the potential return does not justify this type of investment.

Another formation evaluation method uses nitrogen slug tests as a prefracture diagnostic test in low permeability reservoirs as disclosed by Jochen, J. E. et al., *Quantifying Layered Reservoir Properties With a Novel Permeability Test*, SPE 25864 (1993). This method describes a nitrogen injection test as a short small volume injection of nitrogen at a pressure less than the fracture initiation and propagation pressure followed by an extended pressure falloff period. The nitrogen slug test is analyzed using slug-test type curves and by history matching the injection and falloff pressure with a finite-difference reservoir simulator.

Conventional fracture-injection/falloff analysis techniques—before-closure pressure-transient as disclosed by Mayerhofer and Economides, *Permeability Estimation From Fracture Calibration Treatments*, SPE 26039 (1993), and after-closure analysis as disclosed by Gu, H. et al., *Formation Permeability Determination Using Inpulse-Fracture Injection*, SPE 25425 (1993)—allow only specific and small portions of the pressure decline during a fracture-injection/falloff sequence to be quantitatively analyzed. Before-closure data, which can extend from a few seconds to several hours, can be analyzed for permeability and fracture-face resistance, and after-closure data can be analyzed for reservoir transmissibility and average reservoir pressure provided pseudoradial flow is observed. In low permeability reservoirs, however, or when a relatively long fracture is created during an injection, an extended shut-in period—hours or possibly days—are typically required to observe pseudoradial flow. A quantitative transmissibility estimate from the after-closure pre-pseudoradial pressure falloff data, which represents the vast majority of the recorded pressure decline, is not possible with existing limiting-case theoretical models, because existing limiting-case models apply to only the before-closure falloff and the after-closure pressure falloff that includes the pseudoradial flow regime.

Thus, conventional methods to evaluate formation properties suffer from a variety of disadvantages including the lack of the ability to quantitatively determine the reservoir transmissibility, a lack of cost-effectiveness, computational inefficiency, and/or a lack of accuracy. Even among methods developed to quantitatively determine reservoir transmissibility, such methods may be impractical for evaluating formations having multiple layers such as, for example, low permeability stacked, lenticular reservoirs.

SUMMARY

The present invention relates to the field of oil and gas subsurface earth formation evaluation techniques and more particularly, to methods and systems for determining reservoir properties of subterranean formations using fracture-injection/falloff test methods.

An example of a method of determining a reservoir transmissibility of at least one layer of a subterranean formation having a reservoir fluid comprises the steps of: (a) isolating the at least one layer of the subterranean formation to be tested; (b) introducing an injection fluid into the at least one layer of the subterranean formation at an injection pressure exceeding the subterranean formation fracture pressure for an injection period; (c) shutting in the wellbore for a shut-in period; (d) measuring pressure falloff data from the subterranean formation during the injection period and during a subsequent shut-in period; and (e) determining quantitatively the reservoir transmissibility of the at least one layer of the subterranean formation by analyzing the pressure falloff data with a fracture-injection/falloff test model.

An example of a system for determining a reservoir transmissibility of at least one layer of a subterranean formation by using variable-rate pressure falloff data from the at least one layer of the subterranean formation measured during an injection period and during a subsequent shut-in period comprises: a plurality of pressure sensors for measuring pressure falloff data; and a processor operable to transform the pressure falloff data to obtain equivalent constant-rate pressures and to determine quantitatively the reservoir transmissibility of the at least one layer of the subterranean formation by analyzing the variable-rate pressure falloff data using type-curve analysis according to a fracture-injection/falloff test model.

An example of a computer program, stored on a tangible storage medium, for analyzing at least one downhole property comprises executable instructions that cause a computer to determine quantitatively a reservoir transmissibility of the at least one layer of the subterranean formation by analyzing the variable-rate pressure falloff data with a fracture-injection/falloff test model.

The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention and should not be used to limit or define the invention.

DESCRIPTION OF PREFERRED EMBODIMENTS

Figure 1:
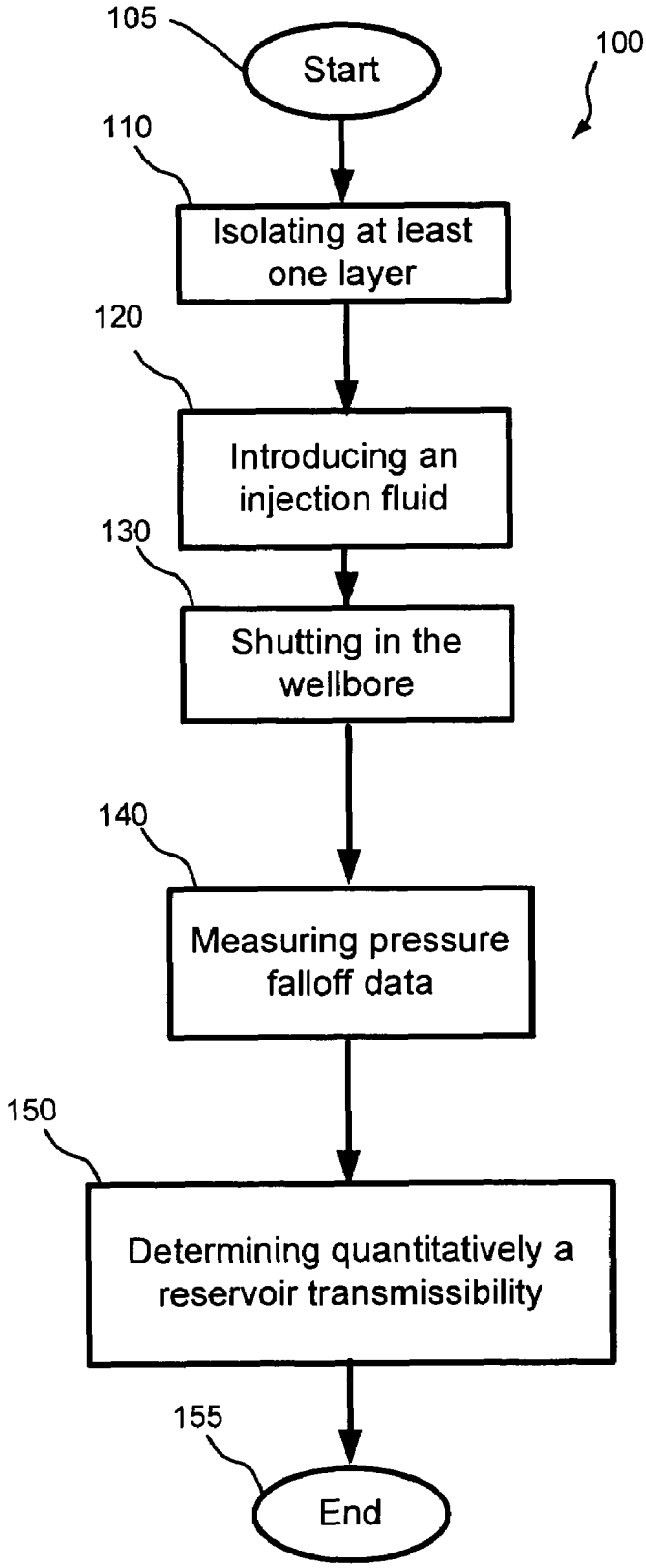
FIG. 1 is a flow chart illustrating one embodiment of a method for quantitatively determining a reservoir transmissibility.

The present invention relates to the field of oil and gas subsurface earth formation evaluation techniques and more particularly, to methods and systems for determining reservoir properties of subterranean formations using fracture-injection/falloff test methods.

Methods of the present invention may be useful for estimating formation properties through the use of fracture-injection/falloff methods, which may inject fluids at pressures exceeding the formation fracture initiation and propagation pressure. In particular, the methods herein may be used to estimate formation properties such as, for example, the reservoir transmissibility and the average reservoir pressure. From the estimated formation properties, the methods of the present invention may be suitable for, among other things, evaluating a formation as a candidate for initial fracturing treatments and/or establishing a baseline of reservoir properties to which comparisons may later be made.

In certain embodiments, a method of determining a reservoir transmissibility of at least one layer of a subterranean formation having a reservoir fluid comprises the steps of: (a) isolating the at least one layer of the subterranean formation to be tested; (b)introducing an injection fluid into the at least one layer of the subterranean formation at an injection pressure exceeding the subterranean formation fracture pressure for an injection period; (c) shutting in the wellbore for a shut-in period; (d) measuring pressure falloff data from the subterranean formation during the injection period and during a subsequent shut-in period; and (e) determining quantitatively a reservoir transmissibility of the at least one layer of the subterranean formation by analyzing the pressure falloff data with a fracture-injection/falloff test model.

The term, "Fracture-Injection/Falloff Test Model," as used herein refers to the computational estimates used to estimate reservoir properties and/or the transmissibility of a formation layer or multiple layers. The methods and theoretical model on which the computational estimates are based are shown below in Sections II and III. This test recognizes that a new induced fracture creates additional storage volume in the formation. Consequently, a fracture-injection/falloff test in a layer may exhibit variable storage during the pressure falloff, and a change in storage may be observed at hydraulic fracture closure. In essence, the test induces a fracture to rapidly determine certain reservoir properties.

More particularly, the methods herein may use an injection of a liquid or a gas in a time frame that is short relative to the reservoir response, which allows a fracture-injection/falloff test to be analyzed by transforming the variable-rate pressure falloff data to equivalent constant-rate pressures and plotting on constant-rate log-log type curves. Type curve analysis allows flow regimes—storage, pseudolinear flow, pseudoradial flow—to be identified graphically, and the analysis permits type-curve matching to determine a reservoir transmissibility. Consequently, substantially all of the pressure falloff data that may measured—from before-closure through after-closure—during a fracture-injection/falloff test may be used to estimate formation properties such as reservoir transmissibility.

The methods and models herein are extensions of and based, in part, on the teachings of Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005), which is incorporated by reference herein in full and U.S. patent application Ser. No. 10/813,698, filed Mar. 3, 2004, entitled "Methods and Apparatus for Detecting Fracture with Significant Residual Width from Previous Treatments., which is incorporated by reference herein in full.

FIG. 1 shows an example of an implementation of the fracture-injection/falloff test method implementing certain aspects of the fracture-injection/falloff model. Method 100 generally begins at step 105 for determining a reservoir transmissibility of at least one layer of a subterranean formation. At least one layer of the subterranean formation is isolated in step 110. During the layer isolation step, each subterranean layer is preferably individually isolated one at a time for testing by the methods of the present invention. Multiple layers may be tested at the same time, but this grouping of layers may introduce additional computational uncertainty into the transmissibility estimates.

An injection fluid is introduced into the at least one layer of the subterranean formation at an injection pressure exceeding the formation fracture pressure for an injection period (step 120). In certain embodiments, the introduction of the injection fluid is limited to a relatively short period of time as compared to the reservoir response time which for particular formations may range from a few seconds to about 10 minutes. In preferred embodiments, the introduction of the injection fluid may be limited to less than about 5 minutes. In certain embodiments, the injection time may be limited to a few minutes. After introduction of the injection fluid, the well bore may be shut-in for a period of time from about a few hours to a few days, which in some embodiments may depend on the length of time for the pressure falloff data to show a pressure falloff approaching the reservoir pressure (step 130).

Pressure falloff data is measured from the subterranean formation during the injection period and during a subsequent shut-in period (step 140). The pressure falloff data may be measured by a pressure sensor or a plurality of pressure sensors. The pressure falloff data may then be analyzed according to step 150 to determine a reservoir transmissibility of the subterranean formation according to the fracture-injection/falloff model as shown below in more detail in Sections II and III. Method 200 ends at step 225.

Figure 2:
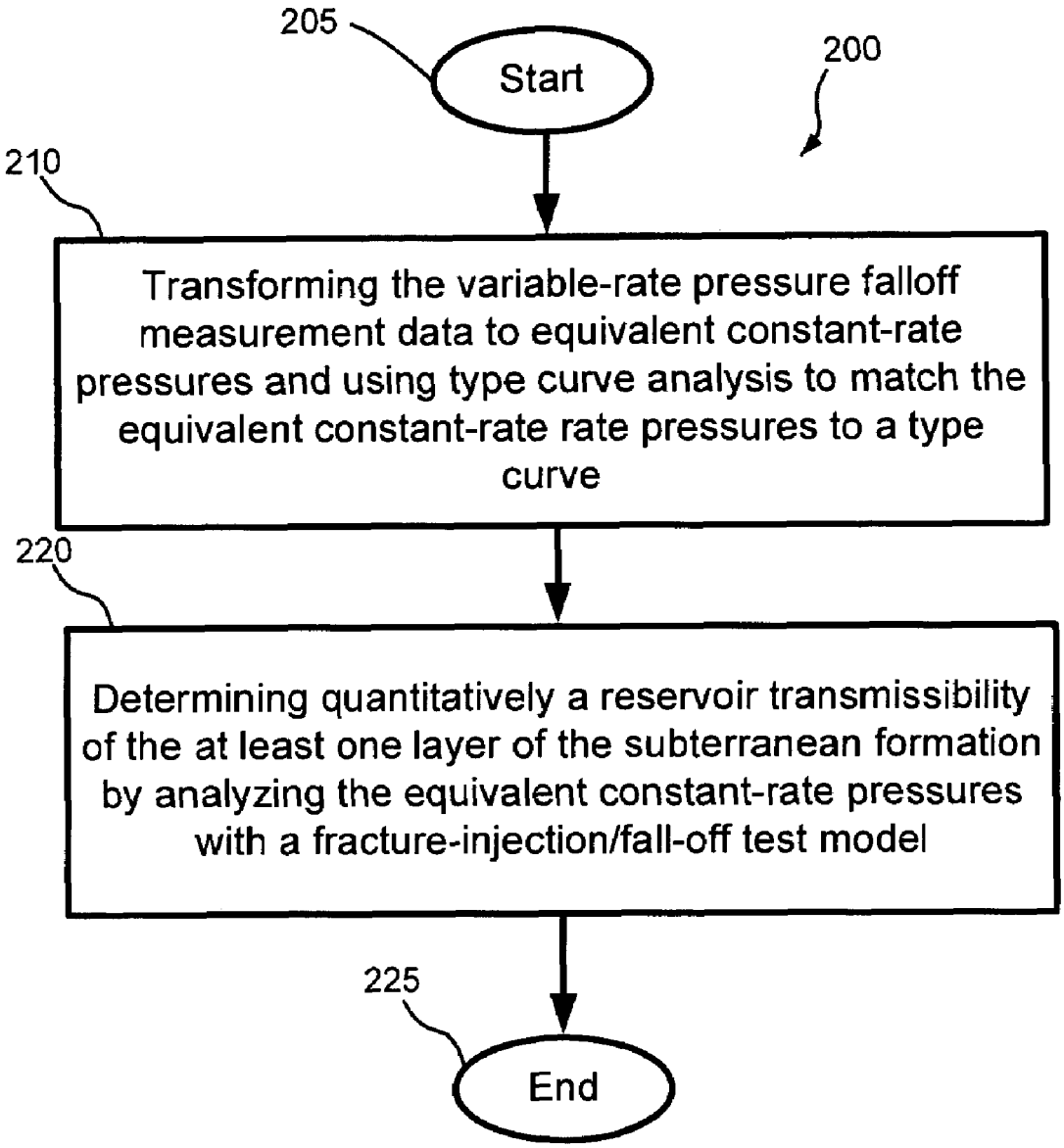
FIG. 2 is a flow chart illustrating one embodiment of a method for quantitatively determining a reservoir transmissibility.

FIG. 2 shows an example implementation of determining quantitatively a reservoir transmissibility (depicted in step 150 of Method 100). In particular, method 200 begins at step 205. Step 210 includes the step of transforming the variable-rate pressure falloff data to equivalent constant-rate pressures and using type curve analysis to match the equivalent constant-rate rate pressures to a type curve. Step 220 includes the step of determining quantitatively a reservoir transmissibility of the at least one layer of the subterranean formation by analyzing the equivalent constant-rate pressures with a fracture-injection/falloff test model. Method 200 ends at step 225.

Figure 3:
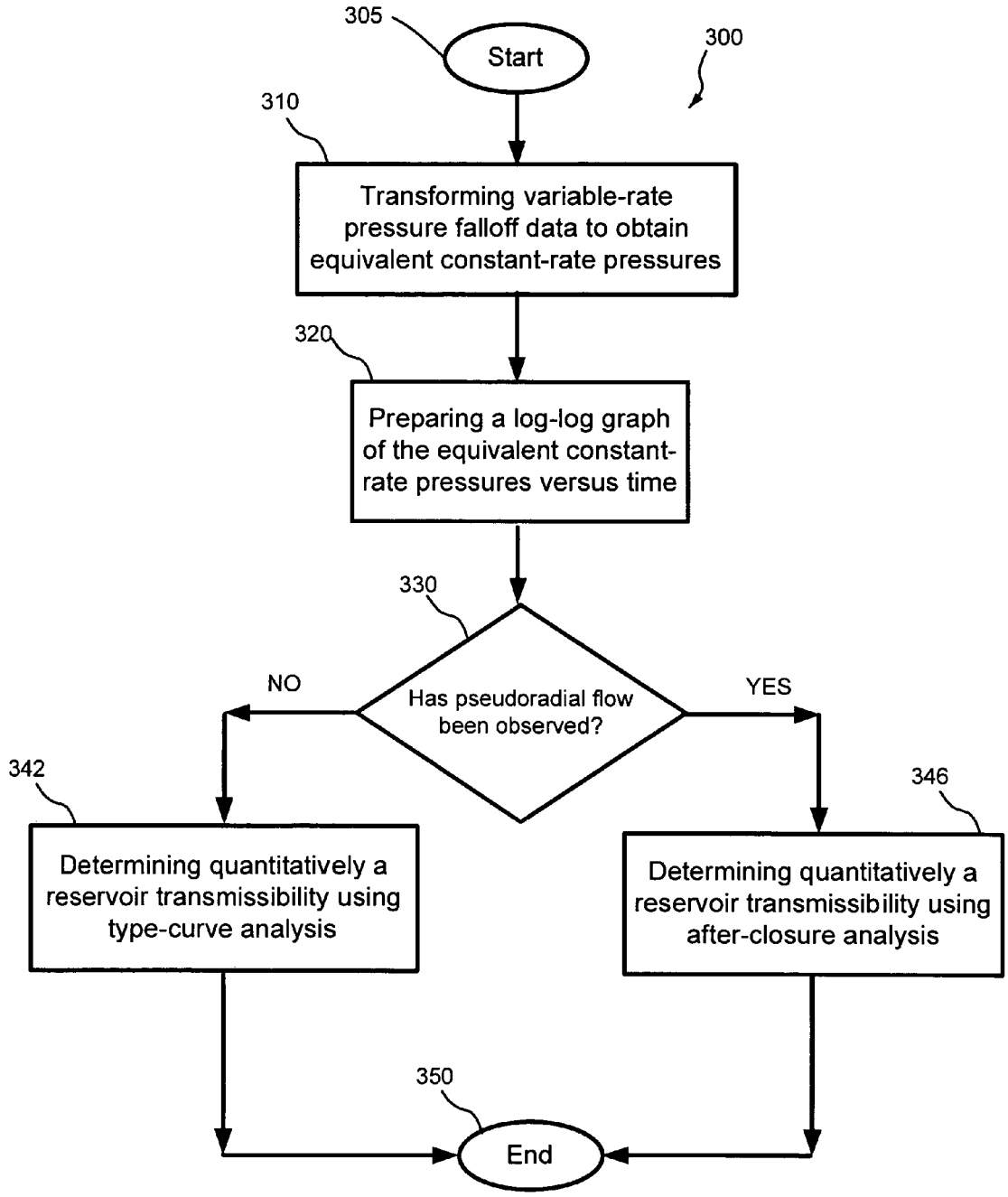
FIG. 3 is a flow chart illustrating one embodiment of a method for quantitatively determining a reservoir transmissibility.

FIG. 3 shows an example implementation of determining a reservoir transmissibility. Method 300 begins at step 305. Measured pressure falloff data is transformed to obtain equivalent constant-rate pressures (step 310). A log-log graph is prepared of the equivalent constant-rate pressures versus time (step 320). If pseudoradial flow has not been observed, type curve analysis may be used to determine quantitatively a reservoir transmissibility according to the fracture-injection/falloff test model (step 342). If pseudoradial flow has been observed, after-closure analysis may be used to determine quantitatively a reservoir transmissibility (step 346). These general steps are explained in more detail below in Sections II and III. Method 300 ends at step 350.

One or more methods of the present invention may be implemented via an information handling system. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU or processor) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

I. Analysis and Interpretation of Data Generally

A qualitative interpretation may use the following steps in certain embodiments:

Identify hydraulic fracture closure during the pressure falloff using methods such as, for example, those disclosed in Craig, D. P. et al., *Permeability, Pore Pressure, and Leakoff-Type Distributions in Rocky Mountain Basins*, SPE Production & Facilities, 48 (February 2005).

The time at the end of pumping, $t_{ne}$, becomes the reference time zero, $\Delta t=0$. Calculate the shut-in time relative to the end of pumping as $$\Delta t=t-t_{ne}, \tag{1}$$

In some cases, $t_{ne}$, is very small relative to t and $\Delta t=t$. As a person of ordinary skill in the art with the benefit of this disclosure will appreciate, $t_{ne}$ may be taken as zero approximately zero so as to approximate $\Delta t$. Thus, the term $\Delta t$ as used herein includes implementations where $t_{ne}$ is assumed to be zero or approximately zero. For a slightly-compressible fluid injection in a reservoir containing a compressible fluid, or a compressible fluid injection in a reservoir containing a compressible fluid, use the compressible reservoir fluid properties and calculate adjusted time as $$t_a = (\mu c_t)_{p0}\int_0^{\Delta t}\frac{d\Delta t}{(\mu c_t)_w} \tag{2}$$

where pseudotime is defined as $$t_p = \int_0^t \frac{dt}{(\mu c_t)_w} \tag{3}$$

and adjusted time or normalized pseudotime is defined as $$t_a = (\mu c_t)_{re}\int_0^t \frac{dt}{\mu_w c_t} \tag{4}$$

where the subscript 're' refers to an arbitrary reference condition selected for convenience.

The pressure difference for a slightly-compressible fluid injection into a reservoir containing a slightly compressible fluid may be calculated as $$\Delta p(t)=p_w(t)-p_i, \tag{5}$$

or for a slightly-compressible fluid injection in a reservoir containing a compressible fluid, or a compressible fluid injection in a reservoir containing a compressible fluid, use the compressible reservoir fluid properties and calculate the adjusted pseudopressure difference as $$\Delta p_a(t)=p_{aw}(t)-p_{ai}, \tag{6}$$

where $$p_a=\left(\frac{\mu z}{p}\right)_{p_i}\int_0^p \frac{p\,dp}{\mu z}. \tag{7}$$

where pseudopressure may be defined as $$p_a=\int_0^p \frac{p\,dp}{\mu z} \tag{8}$$

and adjusted pseudopressure or normalized pseudopressure may be defined as $$p_a=\left(\frac{\mu z}{p}\right)_{re}\int_0^p \frac{p\,dp}{\mu z} \tag{9}$$

where the subscript 're' refers to an arbitrary reference condition selected for convenience.

The reference conditions in the adjusted pseudopressure and adjusted pseudotime definitions are arbitrary and different forms of the solution may be derived by simply changing the normalizing reference conditions.

Calculate the pressure-derivative plotting function as $$\Delta p'=\frac{d(\Delta p)}{d(\ln\Delta t)}=\Delta p\Delta t, \tag{10}$$

or $$\Delta p'_a=\frac{d(\Delta p_a)}{d(\ln t_a)}=\Delta p_a t_a, \tag{11}$$

Transform the recorded variable-rate pressure falloff data to an equivalent pressure if the rate were constant by integrating the pressure difference with respect to time, which may be written for a slightly compressible fluid as $$I(\Delta p)=\int_0^{\Delta t}[p_w(\tau)-p_i]\,d\tau \tag{12}$$

or for a slightly-compressible fluid injected in a reservoir containing a compressible fluid, or a compressible fluid injection in a reservoir containing a compressible fluid, the pressure-plotting function may be calculated as $$I(\Delta p_a)=\int_0^a \Delta p_a\,dt_a. \tag{13}$$

Calculate the pressure-derivative plotting function as $$\Delta p'=\frac{d(\Delta p)}{d(\ln\Delta t)}=\Delta p\Delta t, \tag{14}$$

or $$\Delta p'_a=\frac{d(\Delta p_a)}{d(\ln t_a)}=\Delta p_a t_a, \tag{15}$$

Prepare a log-log graph of $I(\Delta p)$ versus $\Delta t$ or $I(\Delta p_a)$ versus $t_a$.

Prepare a log-log graph of $\Delta p'$ versus $\Delta t$ or $\Delta p'_a$ versus $t_a$.

Examine the storage behavior before and after closure.

Quantitative refracture-candidate diagnostic interpretation requires type-curve matching, or if pseudoradial flow is observed, after-closure analysis. After closure analysis may be performed by methods such as those disclosed in Gu, H. et al., *Formation Permeability Determination Using Impulse-Fracture Injection*, SPE 25425 (1993) or Abousleiman, Y., Cheng, A. H-D. and Gu, H., *Formation Permeability Determination by Micro or Mini-Hydraulic Fracturing*, J. of Energy Resources Technology, 116, No. 6, 104 (June 1994). After-closure analysis is preferable, because it does not require knowledge of fracture half length to calculate transmissibility. However, pseudoradial flow is unlikely to be observed during a relatively short pressure falloff, and type-curve matching may be necessary. From a pressure match point on a constant-rate type curve with constant before-closure storage, transmissibility may be calculated in field units as $$\frac{kh}{\mu}=141.2(24)p_{wsD}(0)C_{bc}(p_0-p_i)\left[\frac{p_{bcD}(t_D)}{\int_0^{\Delta t}[p_w(\tau)-p_i]\,d\tau}\right]_M \tag{16}$$

or from an after-closure pressure match point using a variable-storage type curve $$\frac{kh}{\mu}=141.2(24)[p_{wsD}(0)C_{bc}-p_{wsD}((t_c)_{LfD})[C_{bc}-C_{ac}]]\left(p_0-p_i\right)\left[\frac{p_{acD}(t_D)}{\int_0^{\Delta t}[p_w(\tau)-p_i]\,d\tau}\right]_M \tag{17}$$

Quantitative interpretation has two limitations. First, the average reservoir pressure should be known for accurate equivalent constant-rate pressure and pressure derivative calculations, Eqs. 12 and 15. Second, fracture half length is required to calculate transmissibility. Fracture half length can be estimated by imaging or analytical methods, and the before-closure and after-closure storage coefficients may be calculated with methods such as those disclosed in Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005) and the transmissibility estimated.

II. Fracture-Injection/Falloff Test Model

A fracture-injection/falloff test uses a short injection at a pressure sufficient to create and propagate a hydraulic fracture followed by an extended shut-in period. During the shut-in period, the induced fracture closes—which divides the falloff data into before-closure and after-closure portions. Separate theoretical descriptions of the before-closure and after-closure data have been presented as disclosed in Mayerhofer, M. J. and Economides, M. J., *Permeability Estimation From Fracture Calibration Treatments*, SPE 26039 (1993), Mayerhofer, M. J., Ehlig-Economides, C. A., and Economides, M. J., *Pressure-Transient Analysis of Fracture-Calibration Tests*, JPT, 229 (March 1995), Gu, H., et al., *Formation Permeability Determination Using Impulse-Fracture Injection*, SPE 25425 (1993), and Abousleiman, Y., Cheng, A. H-D., and Gu, H., *Formation Permeability Determination by Micro or Mini-Hydraulic Fracturing*, J. OF ENERGY RESOURCES TECHNOLOGY 116, No. 6, 104 (June 1994).

Mayerhofer and Economides and Mayerhofer et al. developed before-closure pressure-transient analysis while Gu et al. and Abousleiman et al. presented after-closure analysis theory. With before-closure and after-closure analysis, only specific and small portions of the pressure decline during a fracture-injection/falloff test sequence can be quantitatively analyzed.

Before-closure data, which can extend from a few seconds to several hours, can be analyzed for permeability and fracture-face resistance, and after-closure data can be analyzed for reservoir transmissibility and average reservoir pressure provided pseudoradial flow is observed. However, in a low permeability reservoir or when a relatively long fracture is created during the injection, an extended shut-in period—hours or possibly days—are typically required to observe pseudoradial flow. A quantitative transmissibility estimate from the after-closure pre-pseudoradial pressure falloff data, which represents the vast majority of the recorded pressure decline, is not possible with existing theoretical models.

A single-phase fracture-injection/falloff theoretical model accounting for fracture creation, fracture closure, and after-closure diffusion is presented below in Section III. The model accounts for fracture propagation as time-dependent storage, and the fracture-injection/falloff dimensionless pressure solution for a case with a propagating fracture, constant before-closure storage, and constant after-closure storage is written as $$\begin{aligned} p_{wsD}(t_{LfD}) = q_{wsD}[p_{pfD}(t_{LfD}) - p_{pfD}(t_{LfD} - (t_e)_{LfD})] - \\ C_{acD}\int_0^{t_{LfD}} p'_{fD}(t_{LfD} - \tau_D)p'_{wsD}(\tau_D)\,d\tau_D - \\ \int_0^{(t_e)_{LfD}} p'_{pfD}(t_{LfD} - \tau_D)C_{pfD}(\tau_D)p'_{wsD}(\tau_D)\,d\tau_D + \\ C_{bcD}\int_0^{(t_e)_{LfD}} p'_{fD}(t_{LfD} - \tau_D)p'_{wsD}(\tau_D)\,d\tau_D - \\ (C_{bcD} - C_{acD})\int_0^{(t_c)_{LfD}} p'_{fD}(t_{LfD} - \tau_D)p'_{wsD}(\tau_D)\,d\tau_D \end{aligned} \tag{18}$$

where $c_{bcD}$ is the dimensionless before-closure storage, $C_{acD}$ is the dimensionless after-closure storage, and $C_{pfD}$ is the dimensionless propagating-fracture storage coefficient.

Two limiting-case solutions are also developed below in Section III for a short dimensionless injection time, $(t_e)_{LfD}$. The before-closure limiting-case solution, where $(t_e)_{LfD}\square t_{LfD}<(t_c)_{LfD}$ and $(t_c)_{LfD}$ is the dimensionless time at closure, is written as $$p_{wsD}(t_{LfD})=p_{wsD}(0)C_{bcD}p'_{bcD}(t_{LfD}), \tag{19}$$

which is the slug test solution for a hydraulically fractured well with constant before-closure storage. The after-closure limiting-case solution, where $t_{LfD}\square(t_c)_{LfD}\square(t_e)_{LfD}$, is written as $$p_{wsD}(t_{LfD})=[p_{wsD}(0)C_{bcD}-p_{wsD}((t_c)_{LfD})(C_{bcD}-C_{acD})]\,p'_{acD}(t_{LfD}) \tag{20}$$

which is also a slug-test solution but includes variable storage.

Both single-phase limiting-case solutions presented, and other solutions presented by in Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005) illustrate that a fracture-injection/falloff test can be analyzed as a slug test when the time of injection is short relative to the reservoir response.

In a study of the effects of a propagating fracture on injection/falloff data, Larsen, L. and Bratvold, R. B., *Effects of Propagating Fractures on Pressure-Transient Injection and Falloff Data*, SPE 20580 (1990), also demonstrated that when the filtrate and reservoir fluid properties differ, a single-phase pressure-transient model is appropriate if the depth of filtrate invasion is small. Thus, for fracture-injection/falloff sequence with a fracture created during a short injection period, the pressure falloff data can be analyzed as a slug test using single-phase pressure-transient solutions in the form of variable-storage constant-rate drawdown type curves.

Type curve analysis of the fracture-injection/falloff sequence uses transformation of the pressure recorded during the variable-rate falloff period to yield an equivalent "constant-rate" pressure as disclosed in Peres, A. M. M. et al., *A New General Pressure-Analysis Procedure for Slug Tests*, SPE FORMATION EVALUATION, 292 (December 1993). A type-curve match using new variable-storage constant-rate type curves can then be used to estimate transmissibility and identify flow periods for specialized analysis using existing before-closure and after-closure methods as presented in Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005).

Using a derivation method analogous to that shown below in Section III, Craig develops a dimensionless pressure solution for a well in an infinite slab reservoir with an open fracture supported by initial reservoir pressure that closes during a constant-rate drawdown with constant before-closure and after-closure storage, which is written as $$\begin{aligned} p_{wcD}(t_{LfD}) = \\ p_{acD}(t_{LfD}) - (C_{bcD} - C_{acD})\int_0^{(t_c)_{LfD}} p'_{acD}(t_{LfD} - \tau_D)p'_{wcD}(\tau_D)\,d\tau_D \end{aligned} \tag{21}$$

where $p_{wcD}$ denotes that the pressure solution is for a constant rate and $p_{acD}$ is the dimensionless pressure solution for a constant-rate drawdown with constant after-closure storage, which is written in the Laplace domain as $$\bar{p}_{acD} = \frac{\bar{p}_{fD}}{1 + s^2 C_{acD}\bar{p}_{fd}}, \tag{22}$$

and $\bar{p}_{fD}$ is the Laplace domain reservoir solution for a reservoir producing from a single vertical infinite- or finite-conductivity fracture.

Figure 4:
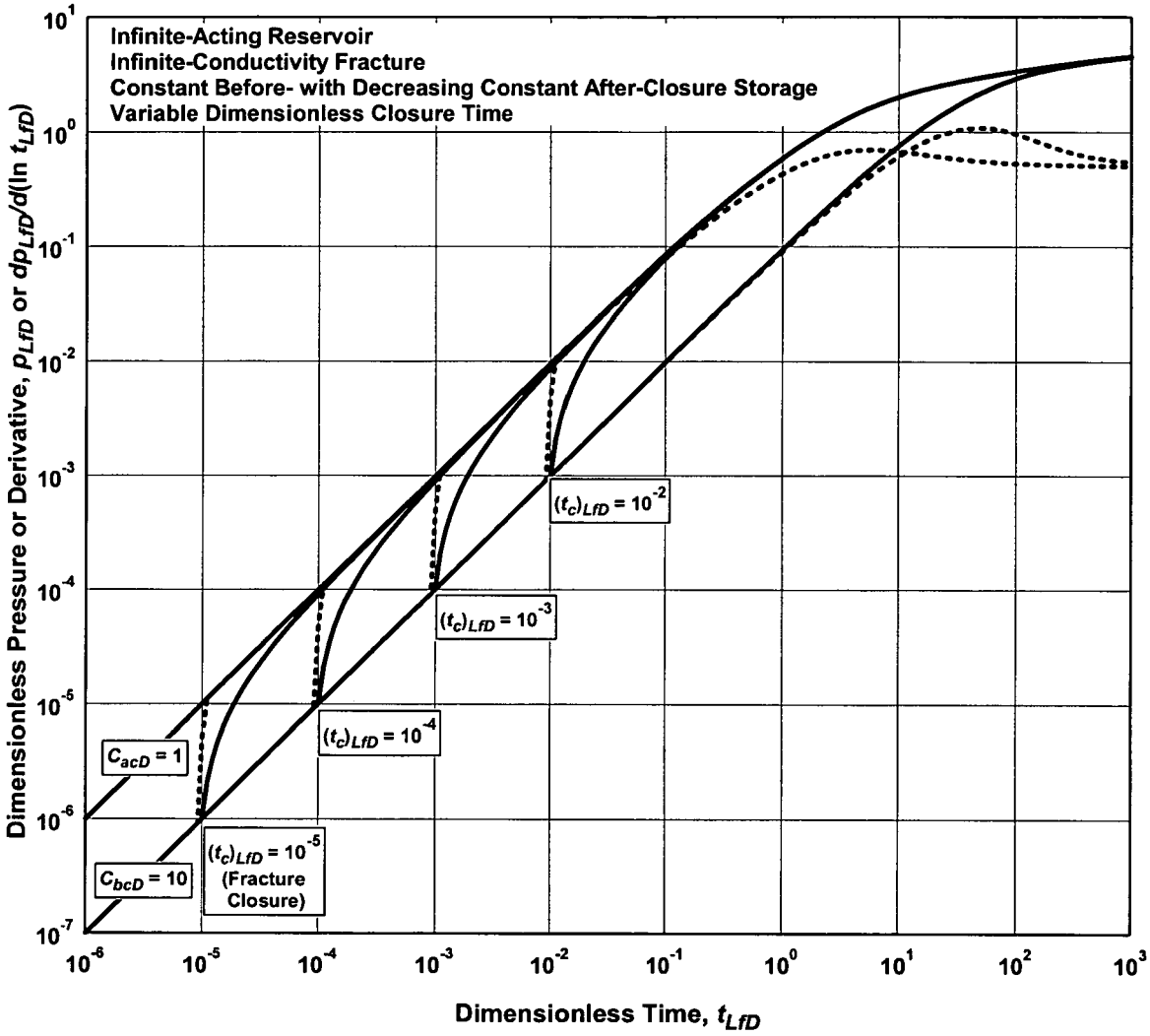
FIG. 4 shows a graph of dimensionless pressure and pressure derivative versus dimensionless time and illustrates a case that exhibits constant before-closure storage, $C_{bcD}=10$, and constant after-closure storage, $C_{acD}=1$, with variable dimensionless closure time.

FIG. 4 shows a graph of dimensionless pressure and pressure derivative versus dimensionless time and illustrates a case that exhibits constant before-closure storage, $C_{bcD}$=10, and constant after-closure storage, $C_{acD}$=1, with variable dimensionless closure time.

Fracture volume before closure is greater than the residual fracture volume after closure, $V_f > V_{fr}$, and the change in fracture volume with respect to pressure is positive. Thus before-closure storage, when a fracture is open and closing, is greater than after-closure storage, which is written as $$c_f V_f + \frac{dV_f}{dp_w} > c_f V_{fr}. \tag{23}$$

Consequently, decreasing storage as shown in FIG. 4 should be expected during a constant-rate drawdown with a closing fracture as has been demonstrated for a closing waterflood-induced fracture during a falloff period by Koning, E. J. L. and Niko, H., *Fractured Water-Injection Wells: A Pressure Falloff Test for Determining Fracturing Dimensions*, SPE 14458 (1985), Koning, E. J. L., *Waterflooding Under Fracturing Conditions*, PhD Thesis, Delft Technical University (1988), van den Hoek, P. J., *Pressure Transient Analysis in Fractured Produced Water Injection Wells*, SPE 77946 (2002), and van den Hoek, P. J., *A Novel Methodology to Derive the Dimensions and Degree of Containment of Waterflood-Induced Fractures From Pressure Transient Analysis*, SPE 84289 (2003).

In certain instances, storage may appear to increase during a constant-rate drawdown with a closing fracture. A variable wellbore storage model for reservoirs with natural fractures of limited extent in communication with the wellbore was disclosed in Spivey, J. P. and Lee, W. J., *Variable Wellbore Storage Models for a Dual-Volume Wellbore*, SPE 56615 (1999). The variable storage model includes a natural fracture storage coefficient and natural fracture skin affecting communication with the reservoir, and a wellbore storage coefficient and a completion skin affecting communication between the natural fractures and the wellbore. The Spivey and Lee radial geometry model with natural fractures of limited extent in communication with the wellbore demonstrates that storage can appear to increase when the completion skin is greater than zero.

The concept of Spivey and Lee may be extended to a constant-rate drawdown for a well with a vertical hydraulic fracture by incorporating fracture-face and choked fracture skin as described by Cinco-Ley, H. and Samaniego-V., F., *Transient Pressure Analysis: Finite Conductivity Fracture Case Versus Damage Fracture Case*, SPE 10179 (1981). The problem is formulated by first considering only wellbore storage and writing a dimensionless material balance equation as $$q_D = q_{wD} - C_D \frac{dp_{wD}}{dt_{LfD}}, \tag{24}$$

where $C_D$ is the dimensionless wellbore storage coefficient written as $$C_D = \frac{c_{wd} V_{wb}}{2\pi\phi c_t h L_f^2}, \tag{25}$$

The dimensionless material balance equation is combined with the superposition integral in the Laplace domain, and the wellbore solution is written as $$\bar{p}_{wD} = \frac{s\bar{p}_{wfD} + (S_{fs})_{ch}}{s[1 + sC_D[s\bar{p}_{wfD} + (S_{fs})_{ch}]]}, \tag{26}$$

where $(S_{fs})_{ch}$ is the choked fracture skin and $\bar{p}_{wfD}$ is the Laplace domain dimensionless pressure solution outside of the wellbore in the fracture.

Before fracture closure, the dimensionless pressure in the fracture outside of the wellbore is simply a function of before-closure fracture storage and fracture-face skin, $S_{fs}$, and may be written in the Laplace domain as $$\bar{p}_{wfD} = \frac{s\bar{p}_{fD} + S_{fs}}{s[1 + sC_{fbcD}[s\bar{p}_{fD} + S_{fs}]]}. \tag{27}$$

where the dimensionless before-closure fracture storage is written as $$C_{fbcD} = \frac{C_{fbc}}{2\pi\phi c_t h L_f^2} \tag{28}$$

and the before-closure fracture storage coefficient is written as $$C_{fbc} = 2c_f V_f + 2\frac{dV_f}{dp_w} \tag{29}$$

The before-closure dimensionless wellbore pressure accounting for fracture-face skin, before-closure storage, choked-fracture skin, and wellbore storage is solved by numerically inverting the Laplace domain solution, Eq. 26 and Eq. 27.

After fracture closure the solution outside of the wellbore accounting for variable fracture storage is analogous to the dimensionless pressure solution for a well in an infinite slab reservoir with an open fracture supported by initial reservoir pressure that closes during the drawdown with constant before-closure and after-closure storage. The solution may be written as $$p_{wfD}(t_{LfD}) = p_{facD}(t_{LfD}) - (C_{fbcD} - C_{facD}) \int_0^{(t_c)_{LfD}} p'_{facD}(t_{LfD} - \tau_D) p'_{wfD}(\tau_D) d\tau_D \tag{30}$$

where the dimensionless after-closure fracture storage is written as $$C_{facD} = \frac{2c_f V_{fr}}{2\pi\phi c_t h L_f^2} \tag{31}$$

and $p_{facD}$ is the dimensionless pressure solution in the fracture for a constant-rate drawdown with constant storage, which is written in the Laplace domain as $$\overline{p}_{facD} = \frac{s\overline{p}_{fD} + S_{fs}}{s[1 + sC_{facD}(s\overline{p}_{fD} + S_{fs})]}. \tag{32}$$

After fracture closure, the dimensionless wellbore pressure solution is obtained by evaluating a time-domain descretized solution of the dimensionless pressure outside of the wellbore and in the fracture at each time $(t_{LfD})_n$. With the time-domain dimensionless pressure outside of the wellbore in the fracture known, the Laplace domain solution, which is written as $$\overline{p}_{wfD} = \overline{p}_{facD} - (C_{fbcD} - C_{facD})s\overline{p}_{facD}\int_0^{(t_c)_{LfD}} e^{-st_{LfD}}\, p'_{wfD}(t_{LfD})dt_{LfD} \tag{33}$$

can be evaluated numerically and combined with the Laplace domain wellbore solution, Eq. 26, and numerically inverted to the time domain as described in Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005).

Figure 5:
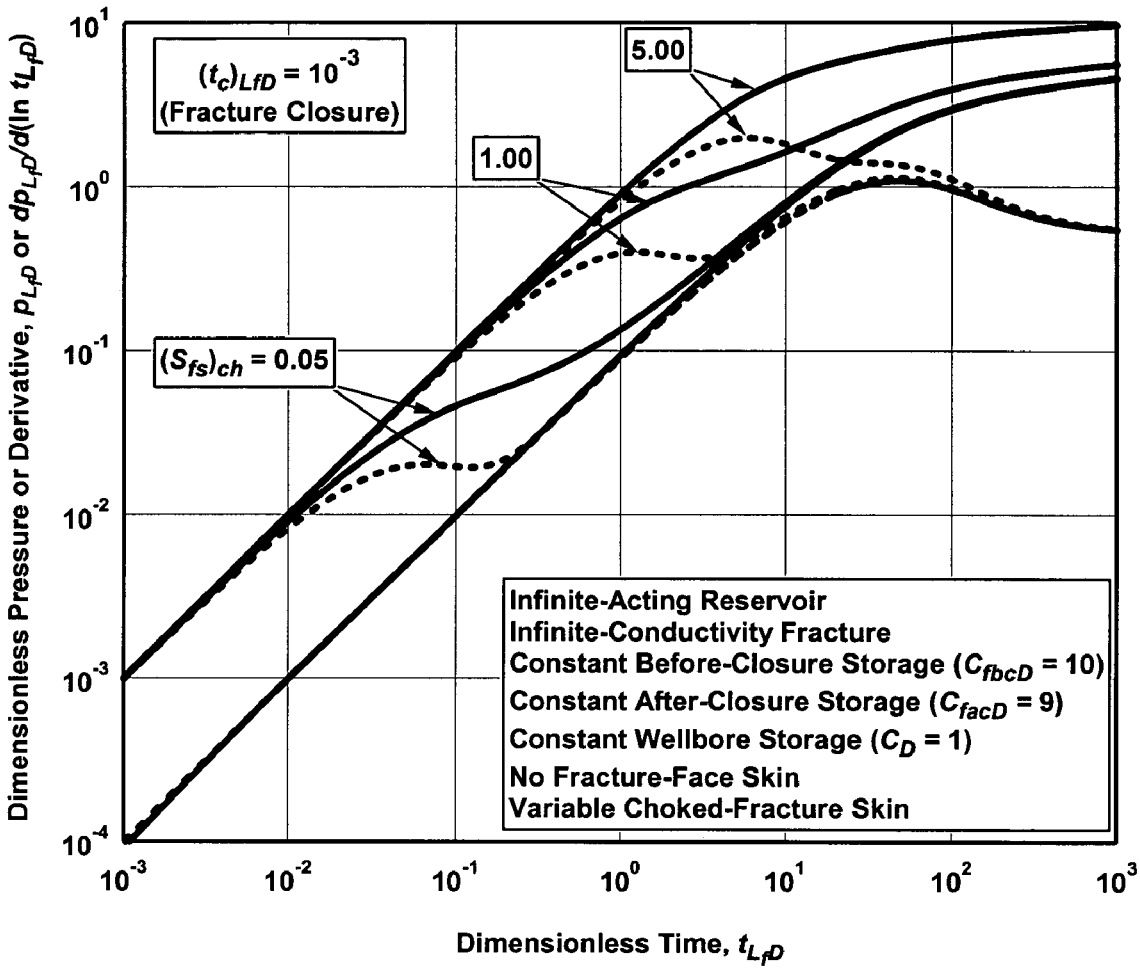
FIG. 5 presents a log-log graph of dimensionless pressure and pressure derivative versus dimensionless time without fracture-face skin, $S_{fs}=0$, but with variable choked-fracture skin, $(S_{fs})_{ch}=\{0.05, 1, 5\}$.

FIG. 5 presents a log-log graph of dimensionless pressure and pressure derivative versus dimensionless time without fracture-face skin, $S_{fs}=0$, but with variable choked-fracture skin, $(S_{fs})_{ch}=\{0.05, 1, 5\}$. FIG. 5 demonstrates that storage appears to increase during a constant-rate drawdown in a well with a closing fracture and choked-fracture skin.

III. Theoretical Model A—Fracture-Injection/Falloff Solution in a Reservoir without a Pre-Existing Fracture Assume a slightly compressible fluid fills the wellbore and fracture and is injected at a constant rate and at a pressure sufficient to create a new hydraulic fracture or dilate an existing fracture. As the term is used herein, the term compressible fluid refers to gases whereas the term slightly compressible fluid refers to liquids. A mass balance during a fracture injection may be written as $$\frac{m_{in}}{q_w B\rho} - \frac{m_{out}}{q_l B_r \rho_r} = \overbrace{V_{wb}\frac{d\rho_{wb}}{dt} + 2\frac{d(V_f\rho_f)}{dt}}^{Storage}, \tag{A-1}$$

where $q_l$ is the fluid leakoff rate into the reservoir from the fracture, $q_l=q_{sf}$, and $V_f$ is the fracture volume.

A material balance equation may be written assuming a constant density, $\rho=\rho_{wb}=\rho_f=\rho_r$, and a constant formation volume factor, $B=B_r$, as $$q_{sf} = q_w - \frac{1}{B}\left(c_{wb}V_{wb} + 2c_f V_f + 2\frac{dV_f}{dp_w}\right)\frac{dp_w}{dt}. \tag{A-2}$$

During a constant rate injection with changing fracture length and width, the fracture volume may be written as $$V_f(p_w(t)) = h_f L(p_w(t))\hat{w}_f(p_w(t)), \tag{A-3}$$

and the propagating-fracture storage coefficient may be written as $$C_{pf}(p_w(t)) = c_{wb}V_{wb} + 2c_f V_f(p_w(t)) + 2\frac{dV_f(p_w(t))}{dp_w}. \tag{A-4}$$

The dimensionless wellbore pressure for a fracture-injection/falloff may be written as $$p_{wsD}(t_{LfD}) = \frac{p_w(t_{LfD}) - p_i}{p_0 - p_i}, \tag{A-5}$$

where $p_i$ is the initial reservoir pressure and $p_0$ is an arbitrary reference pressure. At time zero, the wellbore pressure is increased to the "opening" pressure, $p_{w0}$, which is generally set equal to $p_0$, and the dimensionless wellbore pressure at time zero may be written as $$p_{wsD}(0) = \frac{p_{w0} - p_i}{p_0 - p_i}. \tag{A-6}$$

Define dimensionless time as $$t_{LfD} = \frac{kt}{\phi\mu c_t L_f^2}, \tag{A-7}$$

where $L_f$ is the fracture half-length at the end of pumping. The dimensionless reservoir flow rate may be defined as $$q_{sD} = \frac{q_{sf}B\mu}{2\pi kh(p_0 - p_i)}, \tag{A-8}$$

and the dimensionless well flow rate may be defined as $$q_{wsD} = \frac{q_w B\mu}{2\pi kh(p_0 - p_i)}, \tag{A-9}$$

where $q_w$ is the well injection rate.

With dimensionless variables, the material balance equation for a propagating fracture during injection may be written as $$q_{sD} = q_{wsD} - \frac{C_{pf}(p_w(t))}{2\pi\phi c_t h L_f^2}\frac{dp_{wsD}}{dt_{LfD}}. \tag{A-10}$$

Define a dimensionless fracture storage coefficient as $$C_{fD} = \frac{C_{pf}(p_w(t))}{2\pi\phi c_t h L_f^2}, \tag{A-11}$$

and the dimensionless material balance equation during an injection at a pressure sufficient to create and extend a hydraulic fracture may be written as $$q_{sD} = q_{wsD} - C_{pfD}(p_{wsD}(t_{LfD}))\frac{dp_{wsD}}{dt_{LfD}}. \quad \text{(A-12)}$$

Using the technique of Correa and Ramey as disclosed in Correa, A. C. and Ramey, H. J., Jr., *Combined Effects of Shut-In and Production: Solution With a New Inner Boundary Condition*, SPE 15579 (1986) and Correa, A. C. and Ramey, H. J., Jr., *A Method for Pressure Buildup Analysis of Drillstem Tests*, SPE 16802 (1987), a material balance equation valid at all times for a fracture-injection/falloff sequence with fracture creation and extension and constant after-closure storage may be written as $$\begin{aligned} q_{sD} = q_{wsD} - U_{(t_e)_{LfD}} q_{wsD} - C_{pfD}(p_{wsD}(t_{LfD}))\frac{dp_{wsD}}{dt_{LfD}} + \\ U_{(t_e)_{LfD}}[C_{pfD}(p_{wsD}(t_{LfD})) - C_{bcD}]\frac{dp_{wsD}}{dt_{LfD}} + \\ U_{(t_c)_{LfD}}[C_{bcD} - C_{acD}]\frac{dp_{wsD}}{dt_{LfD}} \end{aligned} \quad \text{(A-13)}$$

where the unit step function is defined as $$U_a = \begin{cases} 0, & t < a \\ 1, & t > a. \end{cases} \quad \text{(A-14)}$$

The Laplace transform of the material balance equation for an injection with fracture creation and extension is written after expanding and simplifying as $$\begin{aligned} \bar{q}_{sD} = \frac{q_{wsD}}{s} - q_{wsD}\frac{e^{-s(t_e)_{LfD}}}{s} - \\ \int_0^{(t_e)_{LfD}} e^{-st_{LfD}} C_{pfD}(p_{wsD}(t_{LfD}))p'_{wsD}(t_{LfD})dt_{LfD} - sC_{acD}\bar{p}_{wsD} + \\ p_{wsD}(0)C_{acD} + \int_0^{(t_e)_{LfD}} e^{-st_{LfD}} C_{bcD}\, p'_{wsD}(t_{LfD})dt_{LfD} - \\ (C_{bcD} - C_{acD})\int_0^{(t_c)_{LfD}} e^{-st_{LfD}} p'_{wsD}(t_{LfD})dt_{LfD} \end{aligned} \quad \text{(A-15)}$$

With fracture half length increasing during the injection, a dimensionless pressure solution may be required for both a propagating and fixed fracture half-length. A dimensionless pressure solution may developed by integrating the line-source solution, which may be written as $$\overline{\Delta p}_{ls} = \frac{\bar{q}\mu}{2\pi ks}K_0(r_D\sqrt{u}), \quad \text{(A-16)}$$

from $x_w - \bar{L}(s)$ and $x_w + \bar{L}(s)$ with respect to $x'_w$ where $\mu = sf(s)$, and $f(s)=1$ for a single-porosity reservoir. Here, it is assumed that the fracture half length may be written as a function of the Laplace variable, s, only. In terms of dimensionless variables, $x'_{wD} = x'_w/L_f$ and $dx'_w = L_f dx'_{wD}$, the line-source solution is integrated from $x_{wD} - \bar{L}_{fD}(s)$ to $x_{wD} + \bar{L}_{fD}(s)$, which may be written as $$\overline{\Delta p} = \frac{\bar{q}\mu L_f}{2\pi ks}\int_{x_{wD}-\bar{L}_{fD}(s)}^{x_{wD}+\bar{L}_{fD}(s)} K_0\left[\sqrt{u}\sqrt{(x_D - x'_{wD})^2 + (y_D - y_{wD})^2}\right]dx'_{wD} \quad \text{(A-17)}$$

Assuming that the well center is at the origin, $x_{wD} = y_{wD} = 0$, $$\overline{\Delta p} = \frac{\bar{q}\mu L_f}{2\pi ks}\int_{-\bar{L}_{fD}(s)}^{\bar{L}_{fD}(s)} K_0\left[\sqrt{u}\sqrt{(x_D - x'_{wD})^2 + (y_D)^2}\right]dx'_{wD} \quad \text{(A-18)}$$

Assuming constant flux, the flow rate in the Laplace domain may be written as $$\bar{q}(s) = 2\bar{q}h\bar{L}(s), \quad \text{(A-19)}$$

and the plane-source solution may be written in dimensionless terms as $$\bar{p}_D = \frac{\bar{q}_D(s)}{\bar{L}_{fD}(s)}\frac{1}{2s}\int_{-\bar{L}_{fD}(s)}^{\bar{L}_{fD}(s)} K_0\left[\sqrt{u}\sqrt{(x_D - \alpha)^2 + (y_D)^2}\right]d\alpha, \quad \text{(A-20)}$$

where $$\bar{p}_D = \frac{2\pi kh\overline{\Delta p}}{\bar{q}\mu}, \quad \text{(A-21)}$$

$$\bar{L}_{fD}(s) = \frac{L(s)}{L_f}, \quad \text{(A-22)}$$

and defining the total flow rate as $\bar{q}_t(s)$, the dimensionless flow rate may be written as $$\bar{q}_D(s) = \frac{\bar{q}(s)}{\bar{q}_t(s)}. \quad \text{(A-23)}$$

It may be assumed that the total flow rate increases proportionately with respect to increased fracture half-length such that $\bar{q}_D(s)=1$. The solution is evaluated in the plane of the fracture, and after simplifying the integral using the identity of Ozkan and Raghavan as disclosed in Ozkan, E. and Raghavan, R., *New Solutions for Well-Test-Analysis Problems: Part 2—Computational Considerations and Applications*, SPEFE, 369 (September 1991), the dimensionless uniform-flux solution in the Laplace domain for a variable fracture half-length may be written as $$\bar{p}_{pfD} = \frac{1}{\bar{L}_{fD}(s)} \quad \text{(A-24)}$$

$$\frac{1}{2s\sqrt{u}}\left[\int_0^{\sqrt{u}(\bar{L}_{fD}(s)+x_D)} K_0[z]dz + \int_0^{\sqrt{u}(\bar{L}_{fD}(s)-x_D)} K_0[z]dz\right]$$

and the infinite conductivity solution may be obtained by evaluating the uniform-flux solution at $x_D=0.732\bar{L}_{fD}(s)$ and may be written as $$\bar{p}_{pfD} = \frac{1}{\bar{L}_{fD}(s)}\frac{1}{2s\sqrt{u}}\left[\int_0^{\sqrt{u}\,\bar{L}_{fD}(s)(1+0.732)} K_0[z]dz + \int_0^{\sqrt{u}\,\bar{L}_{fD}(s)(1-0.732)} K_0[z]dz\right] \quad \text{(A-25)}$$

The Laplace domain dimensionless fracture half-length varies between 0 and 1 during fracture propagation, and using a power-model approximation as shown in Nolte, K. G., *Determination of Fracture Parameters From Fracturing Pressure Decline*, SPE 8341 (1979), the Laplace domain dimensionless fracture half-length may be written as $$\bar{L}_{fD}(s) = \frac{\bar{L}(s)}{\bar{L}_f(s_e)} = \left(\frac{s_e}{s}\right)^{\alpha}, \quad \text{(A-26)}$$

where $s_e$ is the Laplace domain variable at the end of pumping. The Laplace domain dimensionless fracture half length may be written during propagation and closure as $$\bar{L}_{fD}(s) = \begin{cases} \left(\frac{s_e}{s}\right)^{\alpha} & s_e < s \\ 1 & s_e \geq s. \end{cases} \quad \text{(A-27)}$$

where the power-model exponent ranges from $\alpha=1/2$ for a low efficiency (high leakoff) fracture and $\alpha=1$ for a high efficiency (low leakoff) fracture.

During the before-closure and after-closure period—when the fracture half-length is unchanging—the dimensionless reservoir pressure solution for an infinite conductivity fracture in the Laplace domain may be written as $$\bar{p}_{fD} = \frac{1}{2s\sqrt{u}}\left[\int_0^{\sqrt{u}\,(1+0.732)} K_0[z]dz + \int_0^{\sqrt{u}\,(1-0.732)} K_0[z]dz\right]. \quad \text{(A-28)}$$

The two different reservoir models, one for a propagating fracture and one for a fixed-length fracture, may be superposed to develop a dimensionless wellbore pressure solution by writing the superposition integrals as $$p_{wsD} = \int_0^{t_{LfD}} q_{pfD}(\tau_D)\frac{dp_{pfD}(t_{LfD}-\tau_D)}{dt_{LfD}}d\tau_D + \int_0^{t_{LfD}} q_{fD}(\tau_D)\frac{dp_{fD}(t_{LfD}-\tau_D)}{dt_{LfD}}d\tau_D, \quad \text{(A-29)}$$

where $q_{pfD}(t_{LfD})$ is the dimensionless flow rate for the propagating fracture model, and $q_{fD}(t_{LfD})$ is the dimensionless flow rate with a fixed fracture half-length model used during the before-closure and after-closure falloff period. The initial condition in the fracture and reservoir is a constant initial pressure, $p_D=(t_{LfD})=p_{pfD}(t_{LfD})=p_{fD}(t_{LfD})=0$, and with the initial condition, the Laplace transform of the superposition integral is written as $$\bar{p}_{wsD}=\bar{q}_{pfD}\bar{s}\bar{p}_{pfD}+\bar{q}_{fD}\bar{s}\bar{p}_{fD}. \quad \text{(A-30)}$$

The Laplace domain dimensionless material balance equation may be split into injection and falloff parts by writing as $$\bar{q}_{sD}=\bar{q}_{pfD}+\bar{q}_{fD}, \quad \text{(A-31)}$$

where the dimensionless reservoir flow rate during fracture propagation may be written as $$\bar{q}_{pfD} = \frac{q_{wsD}}{s} - q_{wsD}\frac{e^{-s(t_e)_{LfD}}}{s} - \int_0^{(t_e)_{LfD}} e^{-st_{LfD}} C_{pfD}(p_{wsD}(t_{LfD}))p'_{wsD}(t_{LfD})dt_{LfD}, \quad \text{(A-32)}$$

and the dimensionless before-closure and after-closure fracture flow rate may be written as $$\bar{q}_{fD} = \begin{bmatrix} p_{wD}(0)C_{acD} - sC_{acD}\bar{p}_{wsD} + \\ C_{bcD}\int_0^{(t_e)_{LfD}} e^{-st_{LfD}} p'_{wsD}(t_{LfD})dt_{LfD} - \\ (C_{bcD}-C_{acD})\int_0^{(t_c)_{LfD}} e^{-st_{LfD}} p'_{wsD}(t_{LfD})dt_{LfD} \end{bmatrix}. \quad \text{(A-33)}$$

Using the superposition principle to develop a solution requires that the pressure-dependent dimensionless propagating-fracture storage coefficient be written as a function of time only. Let fracture propagation be modeled by a power model and written as $$\frac{A(t)}{A_f} = \frac{h_f L(t)}{h_f L_f} = \left(\frac{t}{t_e}\right)^{\alpha}. \quad \text{(A-34)}$$

Fracture volume as a function of time may be written as $$V_f(p_w(t))=h_f L(p_w(t)\hat{w}_f(p_w(t)), \quad \text{(A-35)}$$

which, using the power model, may also be written as $$V_f(p_w(t)) = h_f L_f \frac{(p_w(t)-p_c)}{S_f}\left(\frac{t}{t_e}\right)^{\alpha}. \quad \text{(A-36)}$$

The derivative of fracture volume with respect to wellbore pressure may be written as $$\frac{dV_f(p_w(t))}{dp_w} = \frac{h_f L_f}{S_f}\left(\frac{t}{t_e}\right)^{\alpha}. \quad \text{(A-37)}$$

Recall the propagating-fracture storage coefficient may be written as $$C_{pf}(p_w(t)) = c_{wb}V_{wb} + 2c_f V_f(p_w(t)) + 2\frac{dV_f(p_w(t))}{dp_w}, \quad \text{(A-38)}$$

which, with power-model fracture propagation included, may be written as $$C_{pf}(p_w(t)) = c_{wb}V_{wb} + 2\frac{h_f L_f}{S_f}\left(\frac{t}{t_e}\right)^{\alpha}(c_f p_n + 1). \quad \text{(A-39)}$$

As noted by Hagoort, J., *Waterflood-induced hydraulic fracturing*, PhD Thesis, Delft Tech. Univ. (1981), Koning, E. J. L. and Niko, H., *Fractured Water-Injection Wells: A Pressure Falloff Test for Determining Fracturing Dimensions*, SPE 14458 (1985), Koning, E. J. L., *Waterflooding Under Fracturing Conditions*, PhD Thesis, Delft Technical University (1988), van den Hoek, P. J., *Pressure Transient Analysis in Fractured Produced Water Injection Wells*, SPE 77946 (2002), and van den Hoek, P. J., *A Novel Methodology to Derive the Dimensions and Degree of Containment of Waterflood-Induced Fractures From Pressure Transient Analysis*, SPE 84289 (2003), $C_f p_n(t) \square 1$, and the propagating-fracture storage coefficient may be written as $$C_{pf}(t_{LfD}) = c_{wb}V_{wb} + 2\frac{A_f}{S_f}\left(\frac{t_{LfD}}{(t_e)_{LfD}}\right)^{\alpha}, \quad \text{(A-40)}$$

which is not a function of pressure and allows the superposition principle to be used to develop a solution.

Combining the material balance equations and superposition integrals results in $$\begin{aligned}\bar{p}_{wsD} = \quad & \text{(A-41)}\\ & q_{wsD}\bar{p}_{pfD} - q_{wsD}\bar{p}_{pfD}e^{-s(t_e)_{LfD}} - C_{acD}[s\bar{p}_{fD}(s\bar{p}_{wsD} - p_{wD}(0))] - \\ & s\bar{p}_{pfD}\int_0^{(t_e)_{LfD}} e^{-st_{LfD}} C_{pfD}(t_{LfD})p'_{wsD}(t_{LfD})dt_{LfD} + \\ & s\bar{p}_{fD}C_{bcD}\int_0^{(t_e)_{LfD}} e^{-st_{LfD}} p'_{wsD}(t_{LfD}) - \\ & s\bar{p}_{fD}\int_0^{(t_c)_{LfD}} e^{-st_{LfD}}[C_{bcD} - C_{acD}]p'_{wsD}(t_{LfD})dt_{LfD}\end{aligned}$$

and after inverting to the time domain, the fracture-injection/falloff solution for the case of a propagating fracture, constant before-closure storage, and constant after-closure storage may be written as $$\begin{aligned}p_{wsD}(t_{LfD}) = \; & q_{wsD}[p_{pfD}(t_{LfD}) - p_{pfD}(t_{LfD} - (t_e)_{LfD})] - \\ & C_{acD}\int_0^{t_{LfD}} p'_{fD}(t_{LfD} - \tau_D)p'_{wsD}(\tau_D)d\tau_D - \\ & \int_0^{(t_e)_{LfD}} p'_{pfD}(t_{LfD} - \tau_D)C_{pfD}(\tau_D)p'_{wsD}(\tau_D)d\tau_D + \\ & C_{bcD}\int_0^{(t_e)_{LfD}} p'_{fD}(t_{LfD} - \tau_D)p'_{wsD}(\tau_D)d\tau_D - \\ & (C_{bcD} - C_{acD})\int_0^{(t_c)_{LfD}} p'_{fD}(t_{LfD} - \tau_D)p'_{wsD}(\tau_D)d\tau_D\end{aligned} \quad \text{(A-42)}$$

Limiting-case solutions may be developed by considering the integral term containing propagating-fracture storage. When $t_{LfD} \square (t_e)_{LfD}$, the propagating-fracture solution derivative may be written as $$p'_{pfD}(t_{LfD} - \tau_D) \cong p'_{pfD}(t_{LfD}), \quad \text{(A-43)}$$

and the fracture solution derivative may also be approximated as $$p'_{fD}(t_{LfD} - \tau_D) \cong p'_{fD}(t_{LfD}). \quad \text{(A-43)}$$

The definition of the dimensionless propagating-fracture solution states that when $t_{LfD} > (t_e)_{LfD}$, the propagating-fracture and fracture solution are equal, and $p'_{pfD}(t_{LfD}) = p'_{fD}(t_{LfD})$. Consequently, for $t_{LfD} \square (t_e)_{LfD}$, the dimensionless wellbore pressure solution may be written as $$p_{wsD}(t_{LfD}) = \begin{bmatrix} p'_{fD}(t_{LfD})\int_0^{(t_e)_{LfD}}[C_{bcD} - C_{fD}(\tau_D)]p'_{wsD}(\tau_D)dt_D - \\ C_{acD}\int_0^{t_{LfD}} p'_{fD}(t_{LfD} - \tau_D)p'_{wsD}(\tau_D)d\tau_D - \\ (C_{bcD} - C_{acD})\int_0^{(t_c)_{LfD}} p'_{fD}(t_{LfD} - \tau_D)p'_{wsD}(\tau_D)d\tau_D \end{bmatrix} \quad \text{(A-45)}$$

The before-closure storage coefficient is by definition always greater than the propagating-fracture storage coefficient, and the difference of the two coefficients cannot be zero unless the fracture half-length is created instantaneously. However, the difference is also relatively small when compared to $C_{bcD}$ or $C_{acD}$, and when the dimensionless time of injection is short and $t_{LfD} > (t_e)_{LfD}$, the integral term containing the propagating-fracture storage coefficient becomes negligibly small.

Thus, with a short dimensionless time of injection and $(t_e)_{LfD} \square t_{LfD} < (t_c)_{LfD}$, the limiting-case before-closure dimensionless wellbore pressure solution may be written as $$\begin{aligned}p_{wsD}(t_{LfD}) = \; & p_{wsD}(0)C_{acD}p'_{acD}(t_{LfD}) - \\ & (C_{bcD} - C_{acD})\int_0^{t_{LfD}} p'_{acD}(t_{LfD} - \tau_D)p'_{wsD}(\tau_D)d\tau_D\end{aligned} \quad \text{(A-46)}$$

which may be simplified in the Laplace domain and inverted back to the time domain to obtain the before-closure limiting-case dimensionless wellbore pressure solution written as $$p_{wsD}(t_{LfD}) = p_{wsD}(0)C_{bcD}p'_{bcD}(t_{LfD}), \quad \text{(A-47)}$$

which is the slug test solution for a hydraulically fractured well with constant before-closure storage.

When the dimensionless time of injection is short and $t_{LfD} \square (t_c)_{LfD} \square (t_e)_{LfD}$, the fracture solution derivative may be approximated as $$p'_{fD}(t_{LfD} - \tau_D) \cong p'_{fD}(t_{LfD}), \quad \text{(A-48)}$$

and with $t_{LfD} \square (t_c)_{LfD}$ and $p'_{acD}(t_{LfD} - \tau_D) \cong p'_{acD}(t_{LfD})$, the dimensionless wellbore pressure solution may written as $$\begin{aligned}p_{wsD}(t_{LfD}) = \; & [p_{wsD}(0)C_{bcD} - p_{wsD}((t_c)_{LfD})(C_{bcD} - C_{acD})] \\ & p'_{acD}(t_{LfD})\end{aligned} \quad \text{(A-49)}$$

which is a variable storage slug-test solution.

IV. Nomenclature

The nomenclature, as used herein, refers to the following terms:

$A$=fracture area during propagation, $L^2$, $m^2$ $A_f$=fracture area, $L^2$, $m^2$ $A_{ij}$=matrix element, dimensionless $B$=formation volume factor, dimensionless $c_f$=compressibility of fluid in fracture, $Lt^2/m$, $Pa^{-1}$ $c_t$=total compressibility, $Lt^2/m$, $Pa^{-1}$ $c_{wb}$=compressibility of fluid in wellbore, $Lt^2/m$, $Pa^{-1}$
C=wellbore storage, $L^4t^2/m$, $m^3/Pa$
$C_f$=fracture conductivity, $m^3$, $m^3$
$C_{ac}$=after-closure storage, $L^4t^2/m$, $m^3/Pa$
$C_{bc}$=before-closure storage, $L^4t^2/m$, $m^3/Pa$
$C_{pf}$=propagating-fracture storage, $L^4t^2/m$, $m^3/Pa$
$C_{fbc}$=before-closure fracture storage, $L^4t^2/m$, $m^3/Pa$
$C_{pLf}$=propagating-fracture storage with multiple fractures, $L^4t^2/m$, $m^3/Pa$
$C_{Lfac}$=after-closure multiple fracture storage, $L^4t^2/m$, $m^3/Pa$
$C_{Lfbc}$=before-closure multiple fracture storage, $L^4t^2/m$, $m^3/Pa$
h=height, L, m
$h_f$=fracture height, L, m
I=integral, m/Lt, Pa·s
k=permeability, $L^2$, $m^2$
$k_x$=permeability in x-direction, $L^2$, $m^2$
$k_y$=permeability in y-direction, $L^2$, $m^2$
$K_0$=modified Bessel function of the second kind (order zero), dimensionless
L=propagating fracture half length, L, m
$L_f$=fracture half length, L, m
$n_f$=number of fractures, dimensionless
$n_{fs}$=number of fracture segments, dimensionless
$p_0$=wellbore pressure at time zero, $m/Lt^2$, Pa
$p_c$=fracture closure pressure, $m/Lt^2$, Pa
$p_f$=reservoir pressure with production from a single fracture, $m/Lt^2$, Pa
$p_i$=average reservoir pressure, $m/Lt^2$, Pa
$p_n$=fracture net pressure, $m/Lt^2$, Pa
$p_w$=wellbore pressure, $m/Lt^2$, Pa
$p_{ac}$=reservoir pressure with constant after-closure storage, $m/Lt^2$, Pa
$p_{Lf}$=reservoir pressure with production from multiple fractures, $m/Lt^2$, Pa
$p_{pf}$=reservoir pressure with a propagating fracture, $m/Lt^2$, Pa
$p_{wc}$=wellbore pressure with constant flow rate, $m/Lt^2$, Pa
$p_{ws}$=wellbore pressure with variable flow rate, $m/Lt^2$, Pa
$p_{fac}$=fracture pressure with constant after-closure fracture storage, $m/Lt^2$, Pa
$p_{pLf}$=reservoir pressure with a propagating secondary fracture, $m/Lt^2$, Pa
$p_{Lfac}$=reservoir pressure with production from multiple fractures and constant after-closure storage, $m/Lt^2$, Pa
$p_{Lfbc}$=reservoir pressure with production from multiple fractures and constant before-closure storage, $m/Lt^2$, Pa
q=reservoir flow rate, $L^3/t$, $m^3/s$
$\tilde{q}$=fracture-face flux, $L^3/t$, $m^3/s$
$q_w$=wellbore flow rate, $L^3/t$, $m^3/s$
$q_l$=fluid leakoff rate, $L^3/t$, $m^3/s$
$q_s$=reservoir flow rate, $L^3/t$, $m^3/s$
$q_t$=total flow rate, $L^3/t$, $m^3/s$
$q_f$=fracture flow rate, $L^3/t$, $m^3/s$
$q_{pf}$=propagating-fracture flow rate, $L^3/t$, $m^3/s$
$q_{sf}$=sand-face flow rate, $L^3/t$, $m^3/s$
$q_{ws}$=wellbore variable flow rate, $L^3/t$, $m^3/s$
r=radius, L, m
s=Laplace transform variable, dimensionless
$S_e$=Laplace transform variable at the end of injection, dimensionless
$S_f$=fracture stiffness, $m/L^2t^2$, Pa/m
$S_{fs}$=fracture-face skin, dimensionless
$(S_{fs})_{ch}$=choked-fracture skin, dimensionless
t=time, t, s
$t_e$=time at the end of an injection, t, s
$t_c$=time at hydraulic fracture closure, t, s
$t_{LfD}$=dimensionless time, dimensionless
u=variable of substitution, dimensionless
$U_a$=Unit-step function, dimensionless
$V_f$=fracture volume, $L^3$, $m^3$
$V_{fr}$=residual fracture volume, $L^3$, $m^3$
$V_w$=wellbore volume, $L^3$, $m^3$
$\hat{w}_f$=average fracture width, L, m
x=coordinate of point along x-axis, L, m
x=coordinate of point along x-axis,, L, m
$\hat{x}_w$=wellbore position along $\hat{x}$-axis, L, m
y=coordinate of point along y-axis, L, m
$\hat{y}$=coordinate of point along $\hat{y}$-axis, L, m
$x_w$=wellbore position along x-axis, L, m
$\alpha$=fracture growth exponent, dimensionless
$\delta_L$=ratio of secondary to primary fracture half length, dimensionless
$\Delta$=difference, dimensionless
$\zeta$=variable of substitution, dimensionless
$\eta$=variable of substitution, dimensionless
$\theta_r$=reference angle, radians
$\theta_f$=fracture angle, radians
$\mu$=viscosity, m/Lt, Pa·s
$\xi$=variable of substitution, dimensionless
$\rho$=density, $m/L^3$, $kg/m^3$
$\tau$=variable of substitution, dimensionless
$\phi$=porosity, dimensionless
$\chi$=variable of substitution, dimensionless
$\psi$=variable of substitution, dimensionless Subscripts
D=dimensionless
i=fracture index, dimensionless
j=segment index, dimensionless
l=fracture index, dimensionless
m=segment index, dimensionless
n=time index, dimensionless To facilitate a better understanding of the present invention, the following example of certain aspects of some embodiments are given. In no way should the following examples be read to limit, or define, the scope of the invention.

EXAMPLES

Field Example

Figure 6:
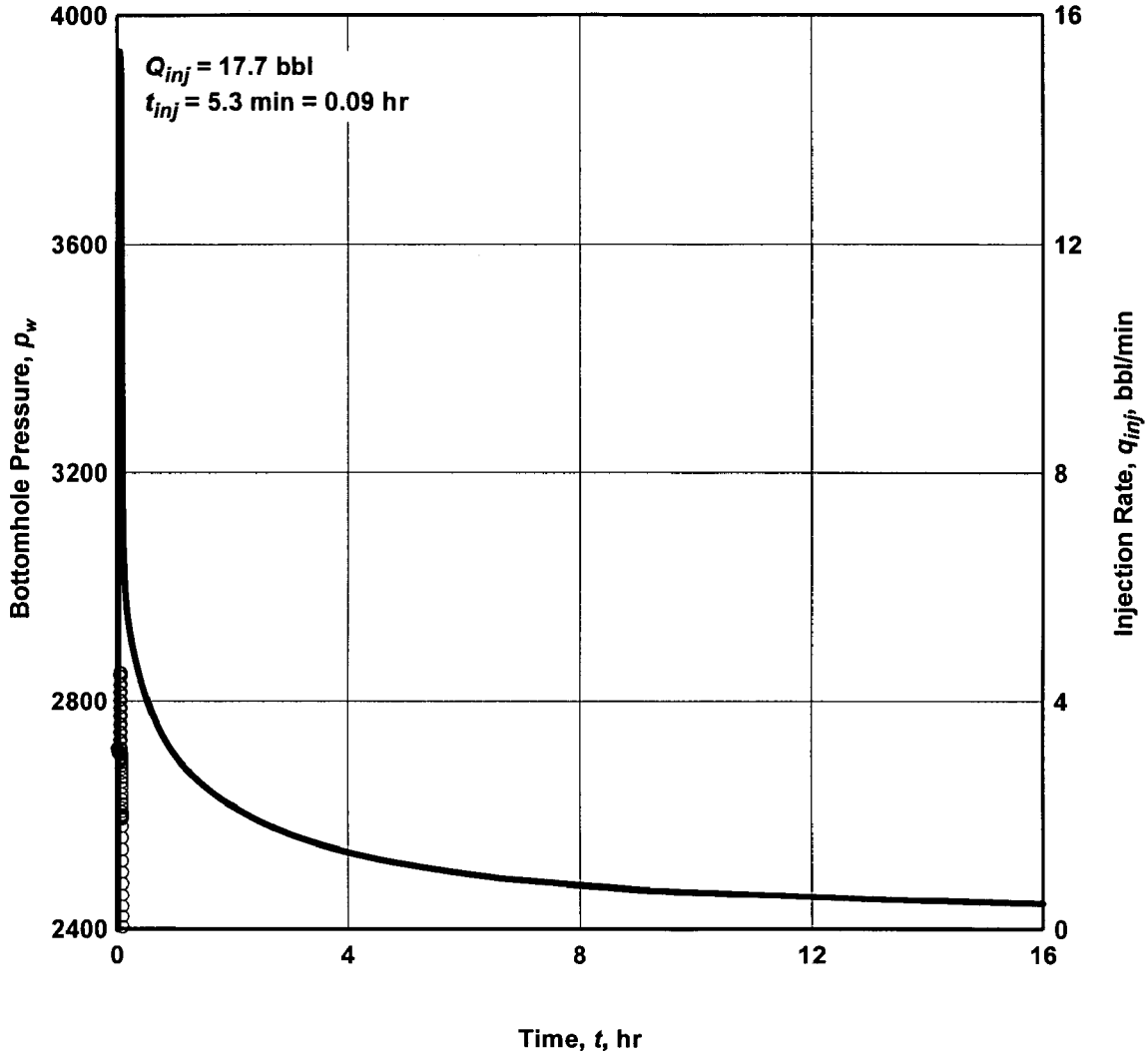
FIG. 6 shows an example fracture-injection/falloff test without a pre-existing hydraulic fracture.
Figure 7:
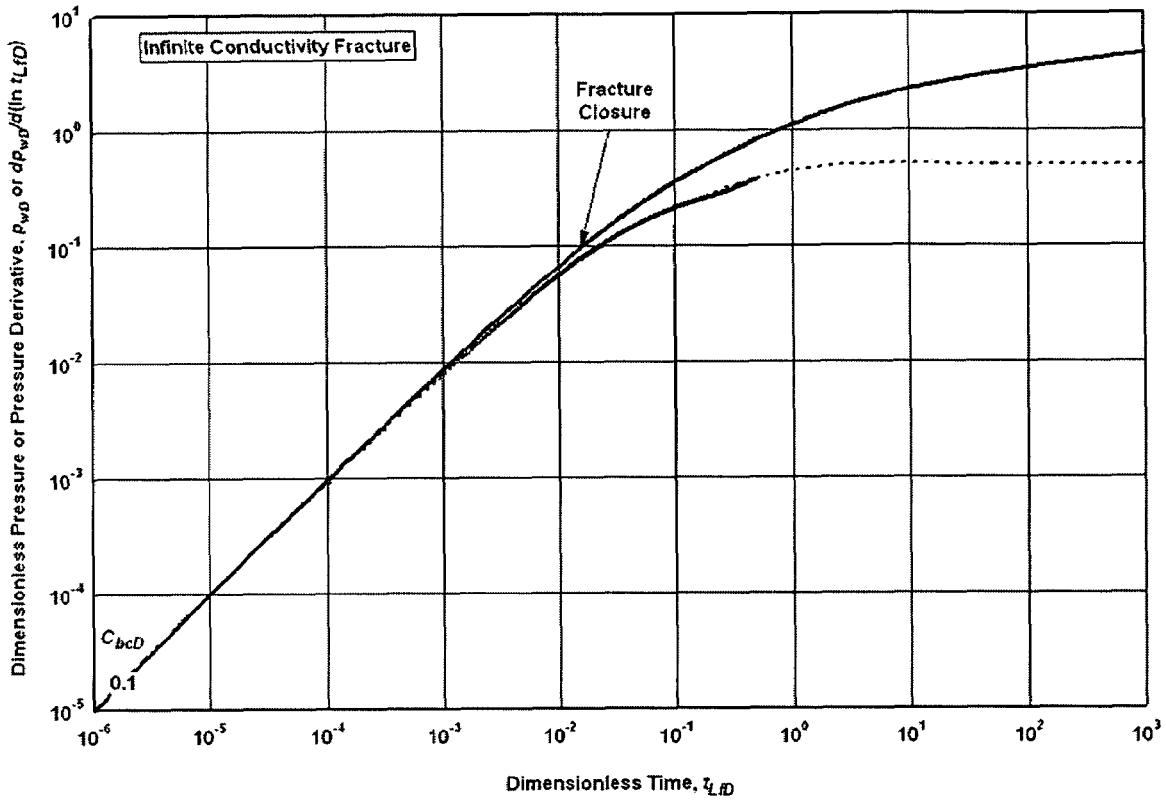
FIG. 7 shows an example type-curve match for a fracture-injection/falloff test without a pre-existing hydraulic fracture.

A fracture-injection/falloff test in a layer without a pre-existing fracture is shown in FIG. 6, which contains a graph of injection rate and bottomhole pressure versus time. A 5.3 minute injection consisted of 17.7 bbl of 2% KCl treated water followed by a 16 hour shut-in period. FIG. 7 contains a graph of equivalent constant-rate pressure and pressure derivative—plotted in terms of adjusted pseudovariables using methods such as those disclosed in Craig, D. P., *Analytical Modeling of a Fracture-Injection/Falloff Sequence and the Development of a Refracture-Candidate Diagnostic Test*, PhD dissertation, Texas A&M Univ., College Station, Tex. (2005)—overlaying a constant-rate drawdown type curve for a well producing from an infinite-conductivity vertical fracture with constant storage. Fracture half length is estimated to be 127 ft using Nolte-Shlyapobersky analysis as disclosed in Valkó, P. P. and Economides, M. J., *Fluid-Leakoff Delineation in High Permeability Fracturing*, SPE PRODUCTION AND FACILITIES (MAY 1986), and the permeability from a type curve match is 0.827 md, which agrees reasonably well with a permeability of 0.522 md estimated from a subsequent pressure buildup test type-curve match.

Thus, the above results show, among other things:

An isolated-layer refracture-candidate diagnostic test may require a small volume, low-rate injection of liquid or gas at a pressure exceeding the fracture initiation and propagation pressure followed by an extended shut-in period.

Provided the injection time is short relative to the reservoir response, a fracture-injection/falloff sequence may be analyzed as a slug test.

Quantitative type-curve analysis using constant-rate drawdown solutions for a reservoir producing from infinite or finite conductivity fractures may be used to estimate reservoir transmissibility of a formation.

Therefore, the present invention is well adapted to attain the ends and advantages mentioned as well as those that are inherent therein. While numerous changes may be made by those skilled in the art, such changes are encompassed within the spirit of this invention as defined by the appended claims. The terms in the claims have their plain, ordinary meaning unless otherwise explicitly and clearly defined by the patentee.

What is claimed is:

1. A method of determining a reservoir transmissibility of at least one layer of a subterranean formation having a reservoir fluid comprising the steps of:

(a) isolating the at least one layer of the subterranean formation to be tested;

(b) introducing an injection fluid into the at least one layer of the subterranean formation at an injection pressure exceeding the subterranean formation fracture pressure for an injection period;

(c) shutting in the wellbore for a shut-in period;

(d) measuring pressure falloff data from the subterranean formation during the injection period and during a subsequent shut-in period; and (e) determining quantitatively the reservoir transmissibility of the at least one layer of the subterranean formation by analyzing the pressure falloff data with a fracture-injection/falloff test model.

2. The method of claim 1 wherein step (e) is accomplished by transforming the pressure falloff data to equivalent constant-rate pressures and using type curve analysis to match the equivalent constant-rate pressures to a type curve to determine quantitatively the reservoir transmissibility.

3. The method of claim 1 wherein step (e) is accomplished by:

transforming the pressure falloff data to obtain equivalent constant-rate pressures;

preparing a log-log graph of the equivalent constant-rate pressures versus time; and determine quantitatively the reservoir transmissibility of the at least one layer of the subterranean formation by analyzing the variable-rate pressure falloff data using type-curve analysis according to a fracture-injection/falloff test model.

4. The method of claim 2 wherein the reservoir fluid is compressible; and wherein the transforming of the pressure falloff data is based on the properties of the compressible reservoir fluid contained in the reservoir wherein the transforming step comprises:

determining a shut-in time relative to the end of the injection period;

determining an adjusted time; and determining an adjusted pseudopressure difference.

5. The method of claim 4 wherein the transforming step comprises:

determining a shut-in time relative to the end of the injection period: $\Delta t = t - t_{ne}$;

determining an adjusted time:

$$t_a = (\overline{\mu c_t}) \int_0^{\Delta t} \frac{d\Delta t}{(\mu c_t)_w};$$

and determining an adjusted pseudopressure difference: $\Delta p_a(t) = p_{aw}(t) - p_{ai}$ where $$p_a = \frac{\overline{\mu}_g \overline{z}}{\overline{p}} \int_0^p \frac{p\,dp}{\mu_g z};$$

wherein:

$t_{ne}$ is the time at the end of the injection period;

$\overline{\mu}$ is the viscosity of the reservoir fluid at average reservoir pressure;

$(\mu c_t)_w$ is the viscosity compressibility product of wellbore fluid at time t;

$(\mu c_t)_0$ is the viscosity compressibility product of wellbore fluid at time $t = t_{ne}$;

p is the pressure;

$\overline{p}$ is the average reservoir pressure;

$p_{aw}(t)$ is the adjusted pressure at time t;

$p_{ai}$ is the adjusted pressure at time $t = t_{ne}$;

$c_t$ is the total compressibility;

$\overline{c}_t$ is the total compressibility at average reservoir pressure; and z is the real gas deviator factor.

6. The method of claim 5 further comprising the step of preparing a log-log graph of a pressure function versus time: $I(\Delta p_a) = f(t_a)$;

where $$I(\Delta p_a) = \int_0^{t_a} \Delta p_a dt_a.$$

7. The method of claim 5 further comprising the step of preparing a log-log graph of a pressure derivative function versus time: $\Delta p_a' = f(t_a)$;

where $$\Delta p_a' = \frac{d(\Delta p_a)}{d(\ln t_a)} = \Delta p_a t_a.$$

8. The method of claim 2 wherein the reservoir fluid is slightly compressible and the transforming of the variable-rate pressure falloff data is based on the properties of the slightly compressible reservoir fluid contained in the reservoir wherein the transforming step comprises:

determining a shut-in time relative to the end of the injection period; and determining a pressure difference.

9. The method of claim 8 the transforming step comprises:

determining a shut-in time relative to the end of the injection period: $\Delta t = t - t_{ne}$; and determining a pressure difference: $\Delta p(t) = p_w(t) - p_i$;

wherein:

$t_{ne}$ is the time at the end of injection period;

$p_w(t)$ is the pressure at time t; and $p_i$ is the initial pressure at time $t = t_{ne}$.

10. The method of claim 9 further comprising the step of preparing a log-log graph of a pressure function versus time: I(Δp)=f(Δt).

11. The method of claim 10 where $$I(\Delta p) = \int_0^{\Delta t} \Delta p d/\Delta t \text{ or } \int_0^{t} \Delta p d/t.$$

12. The method of claim 9 further comprising the step of preparing a log-log graph of a pressure derivatives function versus time: Δp'=f(Δt).

13. The method of claim 12 where $$\Delta p' = \frac{d(\Delta p)}{d(\ln \Delta t)} = \Delta p \Delta t \text{ or } \frac{d(\Delta p)}{d(\ln t)} = \Delta pt.$$

14. The method of claim 9 wherein the reservoir transmissibility is determined quantitatively in field units from a before-closure match point as:

$$\frac{kh}{\mu} = 141.2(24)p_{wsD}(0)C_{bc}(p_0 - p_i)\left[\frac{p_{bcD}(t_D)}{\int_0^{\Delta t}[p_w(\tau) - p_i]d\tau}\right]_M.$$

15. The method of claim 9 wherein the reservoir transmissibility is determined quantitatively in field units from an after-closure match point as:

$$\frac{kh}{\mu} = 141.2(24)p_{awsD}(0)C_{bc}(p_{a0} - p_{ai})\left[\frac{p_{bcD}(t_D)}{\int_0^{\Delta t_a}[p_{aw}(\tau) - p_{ai}]d\tau}\right]_M.$$

16. The method of claim 5 wherein the reservoir transmissibility is determined quantitatively in field units from a before-closure match point as:

$$\frac{kh}{\mu} = 141.2(24)p_{wsD}(0)C_{bc}(p_0 - p_i)\left[\frac{p_{bcD}(t_D)}{\int_0^{\Delta t}[p_w(\tau) - p_i]d\tau}\right]_M.$$

17. The method of claim 5 wherein the reservoir transmissibility is determined quantitatively in field units from an after-closure match point as:

$$\frac{kh}{\mu} = 141.2(24)p_{awsD}(0)C_{bc}(p_{a0} - p_{ai})\left[\frac{p_{bcD}(t_D)}{\int_0^{\Delta t_a}[p_{aw}(\tau) - p_{ai}]d\tau}\right]_M.$$

18. A system for determining a reservoir transmissibility of at least one layer of a subterranean formation by using variable-rate pressure falloff data from the at least one layer of the subterranean formation measured during an injection period and during a subsequent shut-in period, the system comprising:

a plurality of pressure sensors for measuring pressure falloff data; and a processor operable to transform the pressure falloff data to obtain equivalent constant-rate pressures and to determine quantitatively the reservoir transmissibility of the at least one layer of the subterranean formation by analyzing the variable-rate pressure falloff data using type-curve analysis according to a fracture-injection/falloff test model.

19. A computer program, stored on a tangible storage medium, for analyzing at least one downhole property, the program comprising executable instructions that cause a computer to:

determine quantitatively a reservoir transmissibility of the at least one layer of the subterranean formation by analyzing the variable-rate pressure falloff data with a fracture-injection/falloff test model.

20. The computer program of claim 19 wherein the determining step is accomplished by transforming the variable-rate pressure falloff data to equivalent constant-rate pressures and using type curve analysis to match the equivalent constant-rate rate pressures to a type curve to determine the reservoir transmissibility.

21. The computer program of claim 19 wherein the determining step is accomplished by transforming the variable-rate pressure falloff data to equivalent constant-rate pressures and using after closure analysis to determine the reservoir transmissibility.

* * * * *